US008144083B2

(12) United States Patent
Takahashi et al.

(10) Patent No.: US 8,144,083 B2
(45) Date of Patent: Mar. 27, 2012

(54) LIGHT-EMITTING DEVICE, METHOD FOR DRIVING THE SAME DRIVING CIRCUIT AND ELECTRONIC APPARATUS

(75) Inventors: Kasori Takahashi, Suwa (JP); Eiji Kanda, Suwa (JP); Tokuro Ozawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1196 days.

(21) Appl. No.: 11/420,172

(22) Filed: May 24, 2006

(65) Prior Publication Data

US 2006/0267884 A1 Nov. 30, 2006

(30) Foreign Application Priority Data

May 25, 2005 (JP) ..... 2005-151895

(51) Int. Cl.
*G09G 3/30* (2006.01)

(52) U.S. Cl. ..... 345/76; 345/77; 315/169.3

(58) Field of Classification Search ..... 345/76–83; 315/169.3

See application file for complete search history.

(56) References Cited

U.S. PATENT DOCUMENTS 6,229,506 B1 * 5/2001 Dawson et al. ..... 345/82
6,847,340 B2 * 1/2005 Wang et al. ..... 345/76
6,975,290 B2 12/2005 Asano
7,123,220 B2 10/2006 Hanari et al.
7,324,099 B2 1/2008 Akimoto et al.
7,365,713 B2 4/2008 Kimura
7,420,530 B2 * 9/2008 Asano et al. ..... 345/78
7,425,939 B2 9/2008 Asano
7,646,364 B2 * 1/2010 Yamashita et al. ..... 345/77
7,663,615 B2 * 2/2010 Shirasaki et al. ..... 345/204
7,847,762 B2 * 12/2010 Iida et al. ..... 345/76
2003/0117352 A1 * 6/2003 Kimura ..... 345/87
2004/0070557 A1 * 4/2004 Asano et al. ..... 345/76
2005/0088378 A1 * 4/2005 Ozawa et al. ..... 345/76

(Continued)

FOREIGN PATENT DOCUMENTS

JP A-2003-050564 2/2003

(Continued)

OTHER PUBLICATIONS

Apr. 26, 2011 Office Action issued in Japanese Patent Application No. 2010-085792 (with translation).

(Continued)

*Primary Examiner* — Jason Mandeville
(74) *Attorney, Agent, or Firm* — Oliff & Berridge, PLC

(57) ABSTRACT

A method for driving a light-emitting device in which a plurality of pixel circuits are arranged in correspondence with the intersection of a plurality of scanning lines and a plurality data lines, the pixel circuit having a light-emitting element and a driving transistor that controls the current amount of a driving current flowing the light-emitting device, comprises repeating the process within unit period including a first period and a second period following the first period, wherein the second period process includes selecting one scanning line of the plurality of scanning lines, and supplying and holding a data voltage corresponding to the luminance of the light-emitting element to a gate of the driving transistor via the data lines with respect to the plurality pixel circuits connected the selected scanning lines, and wherein the first period process includes selecting two or more scanning lines of the plurality of scanning lines, and correcting the unbalance of the driving current output from the driving transistor in the plurality of pixel circuits connected to the selected scanning lines.

18 Claims, 15 Drawing Sheets

U.S. PATENT DOCUMENTS

| | | | |
|---|---|---|---|
| 2006/0214891 | A1 | 9/2006 | Hanari et al. |
| 2008/0007499 | A1 | 1/2008 | Kawabe |
| 2008/0007546 | A1 | 1/2008 | Kawabe |
| 2008/0284312 | A1 | 11/2008 | Kimura |

FOREIGN PATENT DOCUMENTS

| | | |
|---|---|---|
| JP | A-2003-108075 | 4/2003 |
| JP | A-2003-122303 | 4/2003 |
| JP | A-2003-150082 | 5/2003 |
| JP | A 2003-177709 | 6/2003 |
| JP | A-2003-202834 | 7/2003 |
| JP | A-2004-252105 | 9/2004 |
| JP | A-2004-286816 | 10/2004 |
| JP | A-2005-049430 | 2/2005 |
| JP | A-2005-258326 | 9/2005 |
| JP | A-2005-326793 | 11/2005 |

OTHER PUBLICATIONS

Sep. 7, 2010 Japanese Office Action issued in Japanese Application No. 2010-085792 (with translation).

Sep. 7, 2010 Japanese Office Action issued in Japanese Application No. 2005-151895 (with translation).

* cited by examiner

LIGHT-EMITTING DEVICE, METHOD FOR DRIVING THE SAME DRIVING CIRCUIT AND ELECTRONIC APPARATUS

This application claims the benefit of Japanese Patent Application No. 2005-151895, filed May 25, 2005. The entire disclosure of the prior application is hereby incorporated by reference herein its entirety.

BACKGROUND

1. Technical Field

The present invention relates to a light-emitting device having a light-emitting element such as an organic light-emitting element, a method for driving the same, a driving circuit and an electronic apparatus.

2. Related Art

Recently, an Organic Light-Emitting Diode (hereinafter, referred to as 'OLED element') called an organic electro-luminescent element or a light-emitting polymer element as a next-generation light-emitting diode replacing a liquid crystal element has gotten a lot of attention. Since this OLED element is self-luminous type, it shows low dependence on the view angle and does not need a backlight or reflected light, thereby having excellent characteristics as a display panel such as the reduction of power consumption or thinning. Here, the OLED element is a current-type driven element that does not have the voltage holding like a liquid crystal element and cannot maintain the light emitting state when a current is interrupted. Consequently, when the OLED element is driven in the active matrices mode, it is common that the voltage corresponding to the pixel gradation is input to the gate voltage and the voltage is held by a gate capacitor, etc. and the current corresponding to the gate voltage continuously flows in the writing period (select period).

In this configuration, there is represented the problem that as the threshold voltage characteristic of the driving transistor fluctuates, the brightness of the OLED element for each pixel is various, whereby the visual quality is deteriorated. For this reason, in JP-A-2003-177709 is disclosed the technology that corrects the variance of the threshold voltage characteristic of the driving transistor by programming to input the voltage corresponding to the current to be supplied to the OLED element in the gate of the driving transistor after flowing the constant current from the driving transistor to the data line while connecting the driving transistor to the diode in the writing period.

However, a current that flows the driving transistor gradually approaches zero in the vicinity of the threshold voltage. Consequently, securing sufficient time is required to maintain the voltage corresponding to the gate threshold voltage of the driving transistor. Accordingly, the writing period may get longer so as to implement sufficient correcting.

SUMMARY

An advantage according to an aspect of the present invention is to provide a driving method of the electronic circuit capable of sufficiently correcting the variance of the threshold voltage of the driving transistor without extending the writing period, a driving circuit, a light-emitting device and an electronic apparatus as described above.

A method for driving a light-emitting device in which a plurality of pixel circuits are arranged in correspondence with the intersection of a plurality of scanning lines and a plurality data lines, the pixel circuit having a driving transistor that controls the current amount of a driving current flowing the light-emitting device, comprises repeating the process within unit period including a first period and a second period following the first period, wherein the second period process includes selecting one scanning line of the plurality of scanning lines, and supplying and holding a data voltage corresponding to the luminance of the light-emitting element to a gate of the driving transistor via the data lines with respect to the plurality pixel circuits connected the selected scanning lines, and wherein the first period process includes selecting two or more scanning lines of the plurality of scanning lines, and correcting the unbalance of the driving current output from the driving transistor in the plurality of pixel circuits connected to the selected scanning lines.

According to the invention the light-emitting device is driven by the repetitive process within unit period. In a corresponding period, the first period and second period are exclusively established. In the first period, the correcting is implemented and in the second period, the data voltage is input to the pixel circuit. As the result, in case that certain pixel circuit is focused, the input and the correction are not overlapped. That is, in the unit period which is a basic unit, two operations are carried out by time-sharing. Herewith, the correcting operation may be assigned to a plurality of unit periods. Since two or mores scanning lines are selected, in case that certain pixel circuit is focused, the correcting operation is implemented in two or more periods. Consequently, sufficient time can be secured for the correction, whereby although the threshold voltage of the driving transistor is spread to the manufacturing process, the brightness unbalance can be improved. However, the first period and second period may be not only continuous, but also discontinuous. If the first period and second period are discontinuous, a timely margin between the correcting operation and the writing operation of the data voltage is established. In addition, if the light-emitting element is an element that emits light by receiving the driving current, the element corresponds to, for example, an organic light-emitting diode and an inorganic light-emitting diode.

Here, assuming that the period when the data voltage is supplied held to the gate of the driving transistor is set as the writing period in the second period in each of the plurality of pixel circuits, it is desirable that the plurality of correcting periods are assigned to a part or the whole of the plurality first periods preceding a writing period, whereby the unbalance of the driving current output from the driving transistor is corrected in the plurality of correcting periods. 'The plurality of first periods preceding the writing period' can include the first period of the unit period involving the writing period. 'Assigning the plurality of correcting periods to a part or the whole of the plurality of first periods preceding the writing period', for example, indicates that all of the four first periods are established to the correcting period, or two or thee first periods of them may be established to the correcting period when the first period from the first period to the third period (total four first periods) first before the writing period is set to the plurality of first periods.

More specifically, each of the plurality of pixel circuits includes the holding unit that holds the gate potential of the driving transistor, a first switching unit that is provided between the gate and a drain of the driving transistor, a capacitor element of which one end is connected to the gate of the driving transistor, and a second switching unit that is provided between the data line and the other end of the capacitor element, wherein the first switching unit is turned on, to correct the unbalance of the driving current output from the driving transistor being corrected in the plurality of correcting periods and wherein the second switching unit is turned on while a reference voltage is supplied to the data line in at least the last correcting period of the plurality of correcting periods.

In this case, in the plurality of correcting periods, the first switching unit is turned on, whereby the driving transistor acts as a diode. Then, the gate potential corresponding to the threshold voltage of the driving transistor is held in the holding unit. Further, since the reference voltage is supplied to the other end of the capacitor element in the last correcting period, while the data voltage is supplied to the other end of the capacitor element, the voltage potential of the gate to correct the threshold voltage of the driving transistor is supplied at the time when the writing period is terminated. Herewith, when the unbalance of the threshold voltage of each driving transistor turns up, the brightness unbalance can be prevented all over the screen through the correcting In addition, the second switching unit may be turned on while the reference voltage is supplied to the data line in the whole correcting period.

In addition, with reference to the driving method of the light-emitting device as described above, since the plurality of correcting periods can be assigned to a part of the plurality of first periods preceding the writing period, it is desirable not to correct the unbalance of the driving current output from the driving transistor in the pause period by establishing the pause period in the first period between any correcting period and the subsequent correcting period of the plurality of correcting periods. In this case, the correcting may not be implemented in all the unit period from the unit period involving the first correcting period to the unit period involving the last correcting period, whereby the degree of freedom for processing the correcting can be given.

Further, it is desirable to set the gate potential of the driving transistor to the initialization potential voltage in the initial period by establishing the initialization period in the first period preceding the initial correcting period of the plurality of correcting periods in a accordance with reference to the driving method of the light-emitting device as described above. In this case, the gate potential of the driving transistor can be initialized before the correcting period is commenced, whereby the correcting can be surely operated. Here, it is desirable that the utilization voltage is set to be more than the threshold voltage by flowing the current in case that the gate and drain of the driving transistor are short-circuited. Further, though the correcting may be assigned to the first period, in case that the initial period may be assigned to a part of the first period, the initialization period may be assigned to the first period capable of the initial correcting period and the first period preceding the initial correcting period. In other words, the initialization period may be assigned to the first half of the first period, whereby the first period may be assigned to the latter half thereof.

More specifically, since each of the plurality of pixel circuits has the third switching unit provided between the drain of the driving transistor and the light-emitting element, the first switching unit is turned on, the second switching unit is turned off and the third switching unit is turned on in the initialization period. In this case, an electric charge held in the holding unit in the initialization period is discharged via the third switching unit and light-emitting element, whereby the gate potential of the driving transistor is set as the initialization voltage potential.

In addition, it is desirable to commonly establish the initialization period to all of the plurality of pixel circuits. In this case, since the gate potential of the driving transistor can be set as the initialization voltage potential for all of the pixel circuits if the initialization is once implemented, the processing can be simply and easily performed. More concretely, when the period requiring to select all of the plurality of scanning lines is set to one-frame period, it is desirable to establish the one-frame period once a one-frame period.

Further, with reference to the driving method or the light-emitting device as described above, it is desirable to establish the light-emitting period to supply the driving current to the light-emitting element after the writing period is terminated. In this case, it becomes possible that the light-emitting element is light-emitted when the unbalance of the driving current is corrected. On addition, it is desirable that the light-emitting period is divided into the plurality of periods. In this case, the light-emitting period is diversified to prevent flicker.

Next, a driving circuit for driving a light-emitting device by repeating the process within unit period including a first period and a second period following the first period comprises a plurality of scanning lines, a plurality of data lines, a plurality of first control lines; and a plurality of pixel circuits arranged in correspondence with the intersection of the plurality of scanning lines and the plurality of data lines, wherein each of the plurality of pixel circuits includes a light-emitting element, a driving transistor that controls the amount of current flowing the light-emitting element, a holding unit that holds the gate potential of the driving transistor, a first switching unit provided between a gate and a drain of the driving transistor and the on/off state thereof is controlled based on a first control signal supplied via a first control line, a capacitor element of which one end is connected to the gate of the driving transistor, and a second switching unit provided between the data line and the other end of the capacitor element and the on/off state thereof is controlled based on the scanning signal supplied via the scanning line, wherein the driving circuit comprises a scanning line driving unit that is controlled so that one scanning line of the plurality scanning lines is sequentially selected in a second period, the plurality of scanning signals that selects two or more scanning lines of the plurality of scanning lines in a first period are supplied to the plurality of scanning lines to turn on the second switching unit, a data line driving unit that supplies a reference voltage to the data line in the first period and supplies a data voltage corresponding to the luminance of the light-emitting element to the data line in the second period, and a control line driving unit a supplies a first control signal to each of the plurality of control lines so that the plurality of correcting periods is assigned to a part or the whole of the plurality first periods preceding a writing period assuming that the period when the data voltage is supplied and held to the gate of the driving transistor is set as the writing period in the second period in each of the plurality of pixel circuits, to turn on the first switching unit in the plurality of correcting periods.

Further, with reference to the driving circuit of the light-emitting device, the light-emitting device has the plurality second control lines, and each of the plurality of pixel circuits has a third switching unit provided between the drain and the light-emitting element of the driving transistor and the on/off state thereof is controlled based on a second control signal supplied via the second control line, the light-emitting element, and the control line driving unit supplies the second control signal to each of the plurality of second control lines so that a third switching unit is turned on in an initialization period when the first period preceding an initial correcting period of the plurality of correcting periods is set as the initialization period in each of the plurality of pixel circuits.

In addition, a light-emitting device comprises a plurality of scanning lines) a plurality of data lines, a plurality of first control lines, a plurality of pixel circuits arranged in correspondence with the intersection of a plurality of scanning lines and a plurality of data lines, wherein each of pixel circuits includes a light-emitting element, a driving transistor that controls the current amount of driving current flowing the light-emitting element, a holding unit that holds the gate potential of the driving transistor, a first switching unit provided between the gate and a drain of the driving transistor and the on/off state thereof is controlled based on a first signal supplied via the first control line, a capacitor element of which one end is connected to the gate of the driving transistor, and a second switching unit provided between the data line and the other end of the capacitor element and the on/off state thereof is controlled based on a scanning signal supplied via the scanning line, a data line driving unit that supplies a reference voltage to the data line in a first period and supplies a data voltage corresponding to the luminance of the light-emitting element in a second period by repetitively the process per unit period including the first period and the second period later than the first period, a scanning driving unit that is controlled so that one scanning line of the plurality scanning lines is sequentially selected in the second period, the plurality of scanning signals that selects two or more scanning lines or the plurality of scanning lines in the first period are supplied to the plurality of scanning lines, to turn on the second switching unit, and a control line driving unit that supplies a first control signal to each of the plurality of control lines so that the plurality of correcting periods is assigned to a part or the whole of the plurality first periods preceding a writing period assuming that the period when the data voltage is supplied and held to the gate of the driving transistor is set as the writing period in the second period in each of the plurality of pixel circuits, to turn on the first switching unit in the plurality of correcting periods.

According to the aspect of the invention, since the correcting is implemented in the plurality of the correcting period, whereby although the threshold voltage of the driving transistor is spread to the manufacturing process, the brightness unbalance can be improved. Besides, since the reference voltage and data voltage are supplied to the data line by time-sharing, to be load to the pixel circuit, it is not particularly necessary to provide the wire for supplying the reference voltage to each pixel circuit. As the result, the area of the light-emitting element can be enlarged in the pixel circuit, whereby the aperture ratio can be improved.

A light-emitting device comprises a plurality of second control lines, a plurality of pixel circuits that has a third switching unit provided between a drain of a driving transistor and a light-emitting element and the on/off state thereof is controlled based on a second control signal supplied via a second control line, and a control line driving unit that supplies the second control signal to each of the plurality of second control lines so that a third switching unit is turned on in an initialization period when the first period preceding an initial correcting period of the plurality of correcting periods is set as the initialization period in each of the plurality of pixel circuits.

Next, the electronic apparatuses related to the invention that have the light-emitting device as described above correspond to, for example, a cellular phone, a personal computer, a digital camera and a personal digital assistant.

BRIEF DESCRIPTION OF THE DRAWINGS

The invention will be described with reference to the accompanying drawings, wherein like numbers reference like elements.

DESCRIPTION OF EXEMPLARY EMBODIMENTS

Construction of Light-Emitting Device

Figure 1:
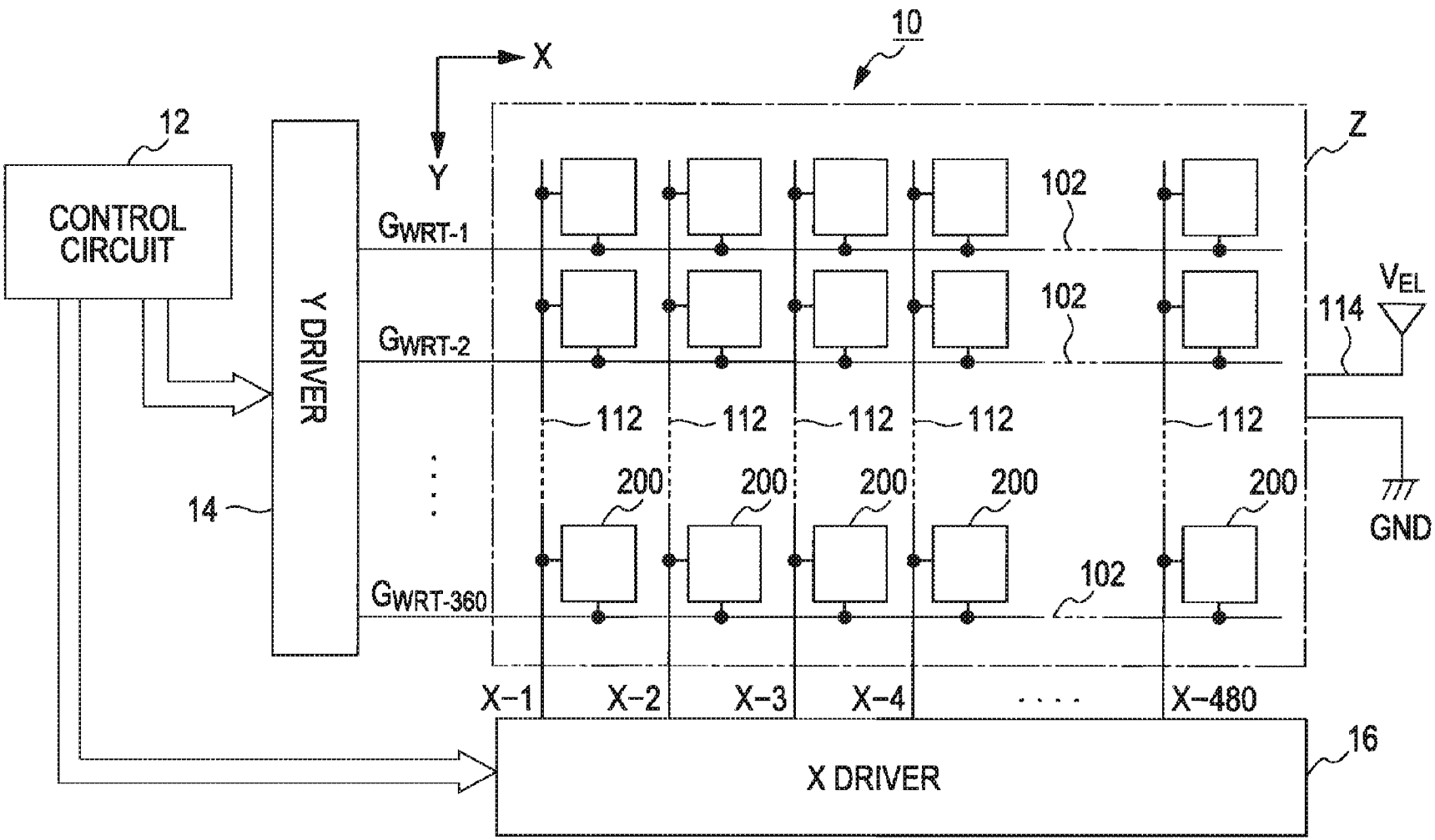
FIG. 1 is a block diagram showing the construction of a light-emitting device according to an embodiment of the invention.
Figure 2:
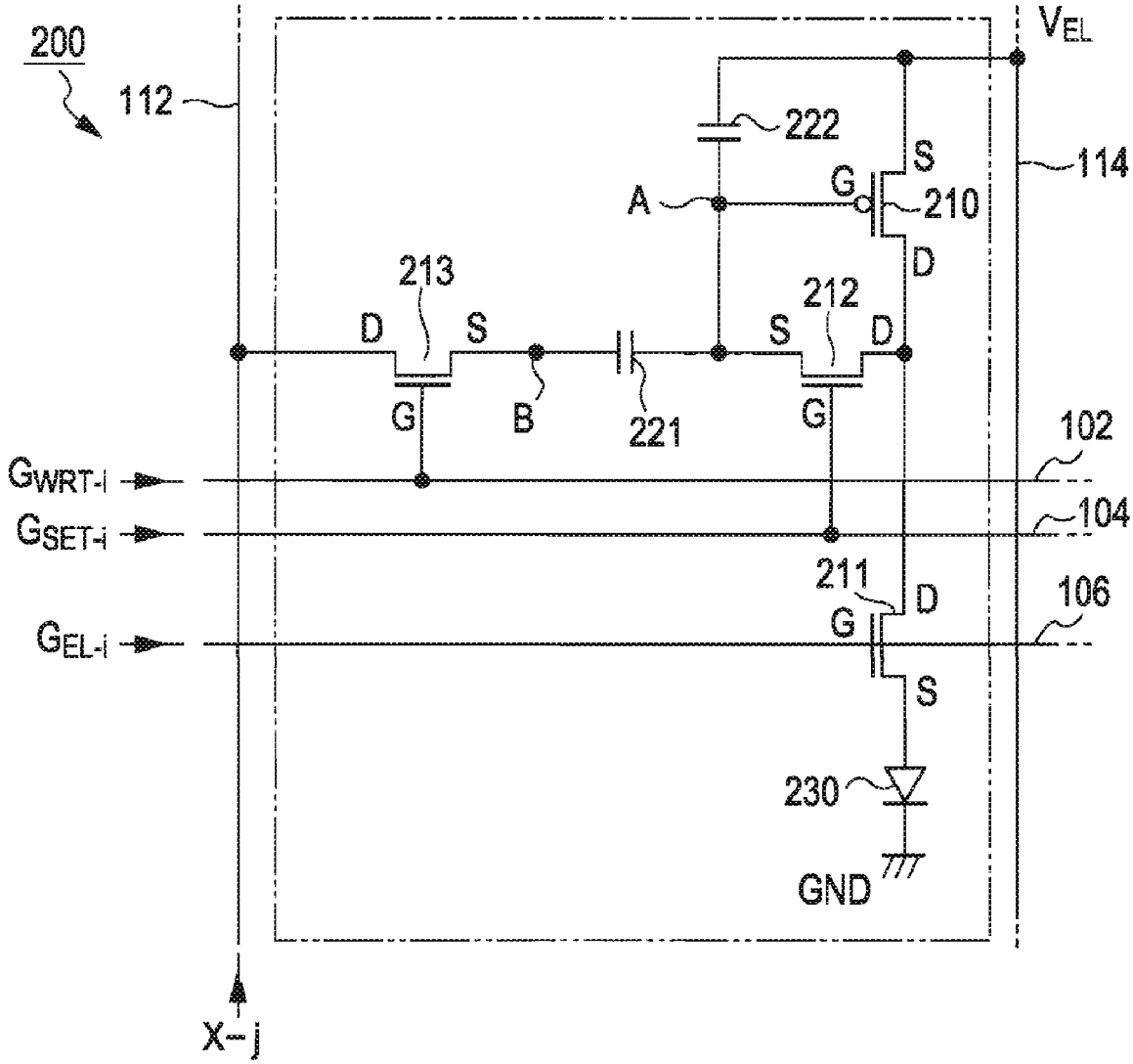
FIG. 2 is a circuit diagram showing a pixel circuit of the light-emitting device.

FIG. 1 is a block diagram showing the construction of a light-emitting device according to an embodiment of the invention and FIG. 2 is a circuit diagram showing a pixel circuit. As shown in FIG. 1, a light-emitting device 10 has a light-emitting zone Z in which a plurality pixel circuits 200 are arranged in a matrix. In the light-emitting zone Z, a plurality of scanning lines 102 are extensively provided in a crosswise direction (X direction), while a plurality of data lines (signal lines) 112 are extensively provided in a lengthwise direction (Y direction) as shown in FIG. 1. And, the pixel circuits (electronic circuits), respectively, 200 are provided so as to correspond to each intersection of the scanning lines 102 and the data lines 112.

For the convenience of description, in this embodiment, the number (number of lines) of scanning lines 102 in the light-emitting zone is set to '360' and the number of (number of rows) is set to '480'. It is assumed that the pixel circuit 200 is arranged in a matrix of 360 lines in depth×480 rows in width. However, the present invention does not mean to be confined to this arrangement. A high voltage $V_{EL}$ and a low voltage GND are supplied from a power supply circuit not shown in the light-emitting zone Z. In the pixel circuit 200 which includes OLED element 230 described below, a current of the OLED element 230 is controlled for each pixel circuit 200, whereby a predetermined image is displayed in gradate.

Further, as shown in FIG. 1, the scanning line 102 only is extensively provided in an X direction, but in this embodiment, in addition to the scanning line 102, the control lines 104 and 106 each are extensively provided in the X direction line by line as shown in FIG. 2. As the result, the scanning line 102, control line 104 (a first control line) and control line 106 (a second control line) constitute one group, thereby being in combination used for the pixel circuit 200 corresponding to one line.

While a Y driver 14 selects the scanning line 102 of one line every one horizontal scanning period and supplies the H-level scanning signal, various control signals synchronized with the selection are supplied to the control lines 104 and 106, respectively. That is, the Y driver 14 supplies the scanning signal or control signal to the scanning line 102, and the control lines 104 and 106 line by line. For the convenience of description, the scanning signal supplier to the scanning line 102 of line i (i is an integral number which satisfies the condition of $1 \leqq i \leqq 360$ and is used for describing the line through the generalization.) is spelled $G_{WRT-i}$. In the same manner, the control signals supplied to the control lines 104 and 106 of line i are spelled $G_{SET-i}$ (the first control signal, and $G_{EL-i}$ (the second control signal), respectively.

Meanwhile, an X driver 16 supplies the data signal of the voltage corresponding to a current (i.e. gradation of pixel) to be flowed to the OLED element 230 of the pixel circuit of one line corresponding to the scanning line 102 selected by the Y driver 14, that is, the pixel circuit 200 of 1 to 480 rows positioned in the selected line via 1st to 480th data lines 112. Here, the data signal (data voltage) is set so that the pixel gets brighter as the voltage is low, while the pixel gets darker as the voltage is high. For the convenience of description, the data signal supplied to the data line to j-th (j is an integral number which satisfies the condition of $1 \leqq j \leqq 480$ and is used for describing the row through the generalization.) data line 112 is spelled X-j.

A high voltage $V_{EL}$ which is a power source of the OLED element 230 is supplied to each of all pixel circuits 200 via a feeder line 114. In addition, all pixel circuits 200 are grounded to the low voltage GND which is a reference of the voltage in accordance with the embodiment. Further, the voltage of the data signal X-j that designates the black which is the lowest gradation of the pixel is set to be lower than the high voltage $V_{EL}$ and the voltage of data signal X-j that designates the white which is the highest gradation is set to be higher than the low voltage GND. In other words, the voltage range of the data signal X-j is set to stay within the power source voltage When a control circuit 12 supplies a clock signal (not shown in Figure) to each of the Y driver 14 and X driver 26, both drivers are controlled and in addition, the image data that establishes the gradation for each pixel is supplied to the X driver 16.

As shown FIG. 2, the pixel circuit 200 has a p-channel driving transistor 210, n-channel transistors 211 (a third switching unit), 212 (a first switching unit) and 213 (a second switching unit) that act as a switching element (a first switching unit), capacitors 221 and 222 that acts as an element, and the OLED element 230. Of them, one end (drain) of the transistor 211 is connected to a drain of the driving transistor 210 and one end (drain) of the transistor 212, while the other end of the transistor 211 is connected to an anode of the OLED element 230. A cathode of the OLED element 230 is grounded. Here, the gate of the transistor 211 is connected to the control line 106 of line i. As the result the transistor 211 is turned on if the control signal $G_{EL-i}$ is H level and off if the control signal $G_{EL-i}$ is L level. The OLED element 230 is electrically inserted into a path between the high voltage $V_{EL}$ and the low voltage GND of the power source with the driving transistor 210 and transistor 211. The gate of the transistor 210 is connected to one end of the capacitors 221 and 222, and a source of the transistor 212, respectively. The other end of the capacitor 222 is connected to the feeder line 114. The capacitor 222 acts as a holding unit that holds the gate potential of the driving transistor 210. Further, for the convenience of description one end (the gate of the driving transistor 210) of the capacitor 221 is called node A. In addition, the capacitor 222 may be a parasitic capacitor generated from the gate capacitor of the driving transistor 210.

While the transistor 212 is electrically inserted between the drain and gate of the driving transistor 210, the gate of the transistor 212 is connected to the control line 104 of line i. As the result, after the transistor 212 is turned on if the control signal $G_{SET-i}$ is H level, the transistor 212 makes the driving transistor 210 operate as a diode. One end (drain) of the transistor 213 is connected to the data line 112 of row j, while the other end (source) thereof is connected to the other end of the capacitor 221. In addition, the gate is connected to the scanning line 102 of line i. As the result, after the transistor 213 is turned on if the scanning signal $G_{WRT-i}$ is H level, the data signal X-j ('s voltage) supplied to the data line 112 of row j is applied to the other end of the capacitor 221. For the convenience of description, the other end (the source of the transistor 213) of the capacitor 221 is called node B.

Further, the pixel circuit 200 arranged in a matrix is formed on the transparent substrates such as glass, etc. with the scanning line 102 or data line 112. As the result, the driving transistor 210 or the transistors 211, 212 and 213 is constructed by a TFT (thin-film transistor by means of the polysilicon process. In addition, the transparent electrode such as an ITO (oxide chloride indium) is set as an anode (individual electrode) and a group metal film or this film stack is set as a cathode (common electrode), whereby the OLED element 230 is constructed to hold the light-emitting layer.

Operation of Light-Emitting Device

Figure 3:
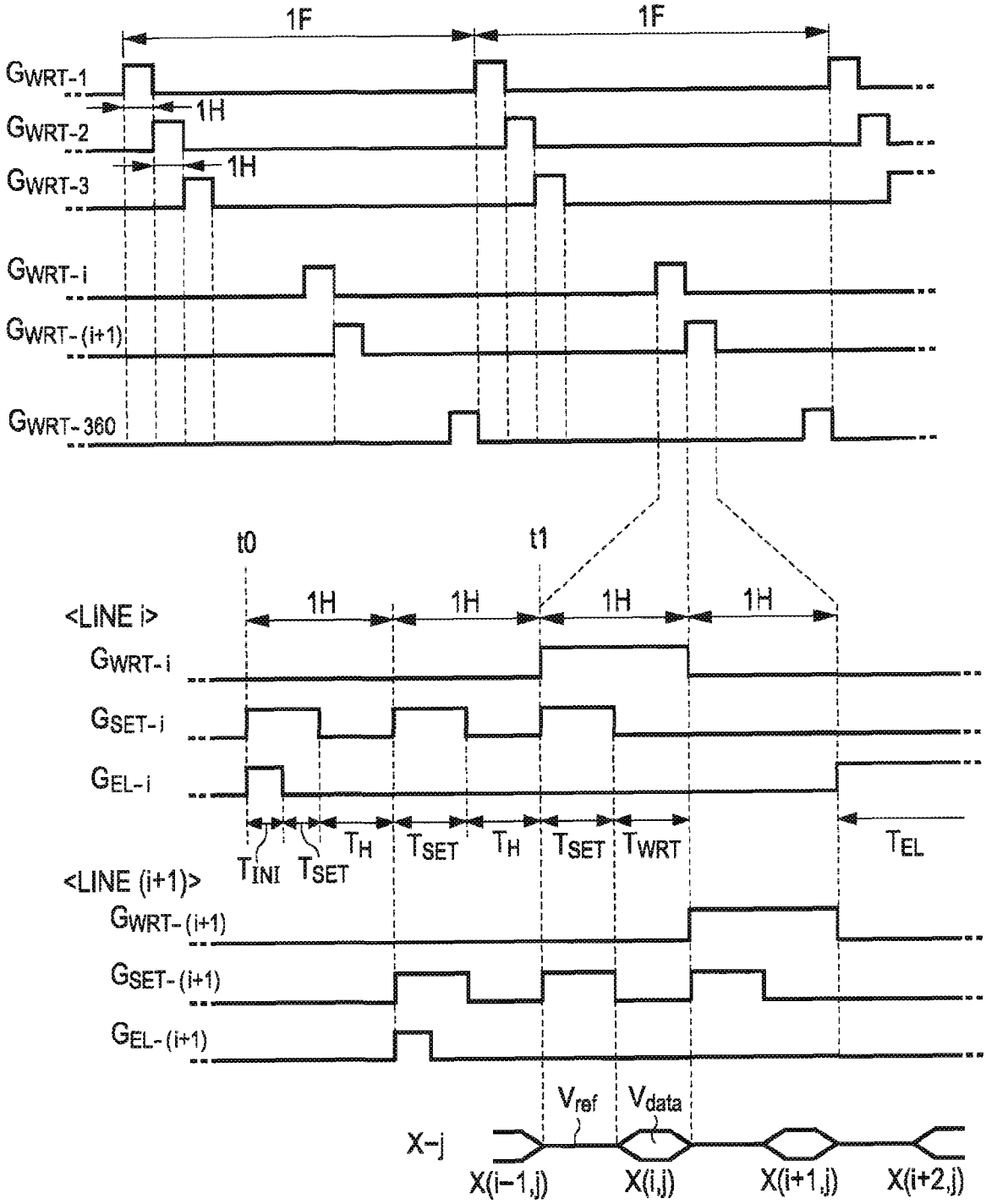
FIG. 3 is a timing chart showing the operation of the light-emitting device.

FIG. 3 is a timing chart showing operation of a light-emitting device 10. First, after a Y driver 14 sequentially selects one of the scanning lines 102 of line 1, line 2, line 3, . . . , line 360 from the commencement of 1 vertical scanning period (1 F) every the horizontal scanning period (1 H) the only scanning signal of the selected scanning line 102 is set to H level and the scanning signal of the other scanning line is set to L level. Here, since the horizontal scanning period is the unit of driving operation, an image is formed on the screen 1. Here, by considering horizontal scanning period (1 H) when the scanning line 102 of line i is selected and the scanning signal $G_{WRT-i}$ is H level the horizontal scanning period and the operation before and after the same are will described in reference to FIGS. 4 to 9 in addition to FIG. 3.

As shown in FIG. 3, when 1 horizontal scanning line (1 H) commenced from the timing t1 when the scanning signal $G_{WRT-i}$ is H level and each horizontal scanning period of two 1 horizontal scanning period (1 H×2) preceding the 1 horizontal scanning period, the advance preparation for the writing operation of the pixel circuit 200 is made in line i ×row j in each of horizontal scanning line. And, the writing operation is carried out in 1 horizontal scanning period (1 H) commenced from the timing t1, the writing operation is terminated and 1 horizontal scanning period (1 H) elapses, whereby the light-emitting is commenced.

More specifically, in 1 horizontal scanning period (1 H) when the scanning signal $G_{WRT-i}$ is changed to H level and the first half period when each horizontal scanning period of two 1 horizontal scanning periods (1 H×2) preceding the 1 horizontal scanning period (1 H) is divided into two periods such as a first half and a latter half, the advance preparation for the writing operation of the pixel circuit 200 is made. Further, the 1 horizontal scanning line (1 H) when the scanning signal $G_{WRT-i}$ is changed to H level performs the writing in the second period of the first period of the first half and the second period of the latter half.

As described below, the period for the advance preparation s called the correcting period $T_{SET}$, the period for the writing operation is called the program period $T_{WRT}$ (writing period) and the period when a current is supplied to the OLED element 230 is called TEL. In the correcting period $T_{SET}$, the amount or the current of the driving current IEL is corrected for the threshold $V_{th}$ of the driving transistor. In addition, the program period $T_{WRT}$ can be assigned to the latter half (the second period) of the horizontal scanning period, whereby the correcting period $T_{SET}$ can be assigned to the first half (the first period) of a plurality of horizontal scanning periods positioned preceding the program period $T_{WRT}$.

Further, in 1 horizontal scanning period (1 H) commenced from the timing t0, an initialization period $T_{INI}$ for initializing the pixel circuit 200 of i lines×j rows is provided preceding the advance preparation for the writing operation in the first half (the first period). In the initialization period $T_{INI}$, the Y driver 14 sets the control signal $G_{SET-i}$ to H level and the control $G_{EL-i}$ to L level. As the result, in the pixel circuit 200, the transistor 212 is turned on by the control signal $G_{SET-i}$ of H level and the transistor 211 is turned on by the control signal $G_{EL-i}$ of the same H level as shown in Fig, 4. Herewith, in the initialization period $T_{INI}$, in the pixel circuit 200, the low voltage GND as the initialization voltage of the node A is supplied via the transistor 212 and OLED element 230, so that the voltage potential of the node A is fixed to the voltage raised only by the threshold voltage of the OLED element 230 from the low voltage GND. Further, in the initialization period $T_{INI}$, since when the scanning signal $G_{WRT-i}$ is L level, whereby the transistor 213 is turned off, the voltage of the data line 112 of row j is not taken up to the pixel circuit 200. Consequently, though the reference voltage $V_{ref}$ is supplied to the data line 112 of row j, it is not taken up to the pixel circuit 200.

Figure 5:
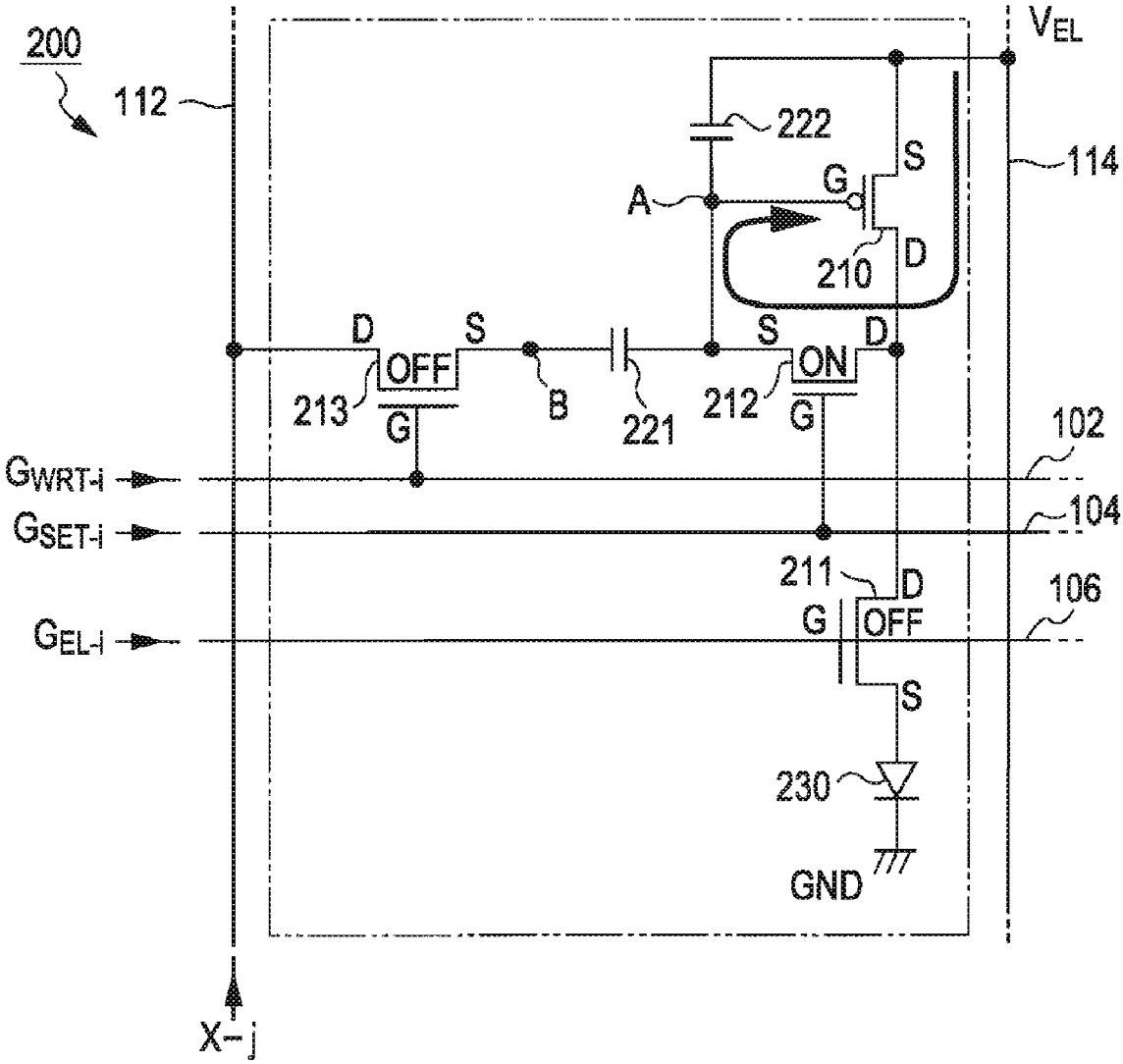
FIG. 5 is an operation explanatory view of the pixel circuit.

In the correcting period $_{TSET}$ continued from the initialization period $T_{INI}$, the Y driver 14 sets the control signal $G_{SET-i}$ to H level continuing from the initialization period $T_{INI}$, while sets $G_{EL-i}$ to L level. In other words, the initialization period $T_{INI}$ is provided in the first period prior the initial correcting period $T_{SET}$. In the correcting period $T_{INI}$, in the pixel circuit 200, the transistor 212 continues being on from the initialization period $T_{INI}$ by the control signal $G_{SET-i}$ of H level, while the transistor 211 is turned off by the control signal $G_{EL-i}$ of L level as shown in FIG. 5. Herewith, the driving transistor 210 acts as a diode.

Here, the threshold voltage of the driving transistor 210 is set to $V_{th}$, in case that the correcting period $T_{SET}$ is long, the voltage potential Vg on node A is raised from the low voltage GND by taking a time, thereby gradually approaching '$V_{EL}-V_{th}$'. Although the transistor 211 is turned off, the reason why the voltage potential Vg does not promptly approach '$V_{EL}-V_{th}$' is that an integral circuit is equivalently constructed a resistance of the transistor 212, wiring resistance, capacitor 222 or the like. That is, in case that the correcting period $T_{SET}$ is short, when the correcting period $T_{SET}$ is terminated, the voltage potential Vg on node A does not sufficiently approach '$V_{EL}-V_{th}$' and becomes the voltage potential $V_h$ ($0<V_h<(V_{EL}-V_{th})$) corresponding to the length of the correcting period $T_{SET}$.

Figure 6:
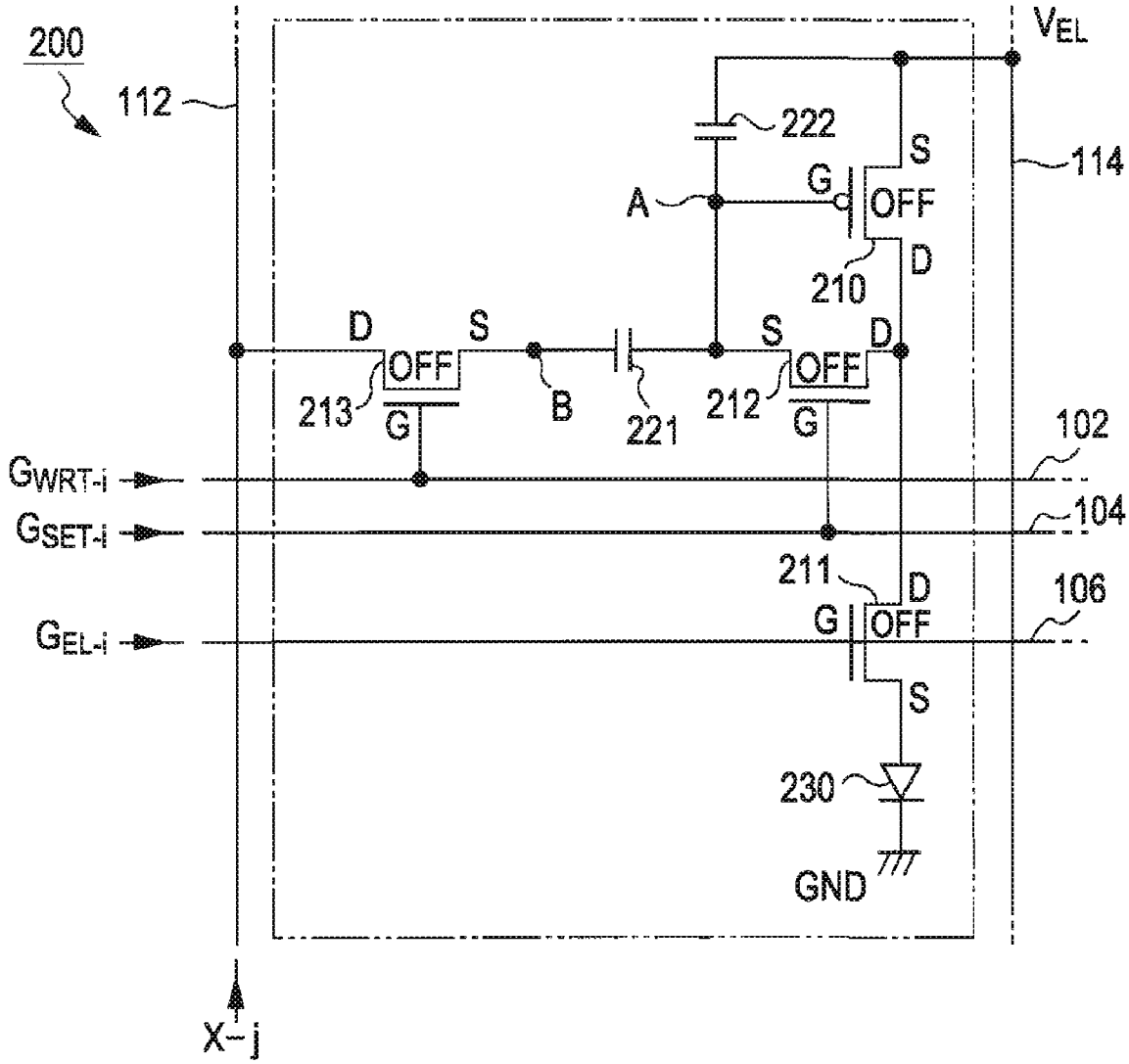
FIG. 6 is an operation explanatory view of the pixel circuit.

Next, the latter half of 1 horizontal scanning period (1 H) commence from the timing t0 corresponds to the holding period $T_H$ that holds the electrical state of the pixel circuit, that is, the voltage potential of node A. That is, in the holding period $T_H$, the Y driver 14 sets the control signal $G_{SET-i}$ and the control signal $G_{EL-i}$ to L level. As the result, in the pixel circuit 200, the transistors 211 and 212 all are off by the control signals $GS_{ET-i}$ and $G_{EL-i}$ of L level as shown in FIG. 6. As the result, the voltage potential Vg of node A is held in the voltage potential $V_h$ which has been changed in the first-half correcting period $T_{SET}$ of 1 horizontal scanning period (1 H).

In the following 1 horizontal scanning period (1 H), the first half is the correcting period $T_{SET}$ and the latter half is the holding period $T_H$. Consequently, in, the correcting period $T_{SET}$, in the same manner as above, the control signal, $G_{SET-i}$ is set to H level and the control signal $G_{EL-i}$ is set to L level. Herewith, the driving transistor 210 acts as a diode. As the result, the voltage potential Vg of node A is raised still higher than the voltage potential $V_h$ having been held in the holding period $T_H$ described above, thereby being the voltage potential $V_h'$ ($V_h<V_h'<(V_{EL}-V_{th})$) to come close to '$V_{EL}-V_{th}$'. And, in the holding period $T_H$ continuing from this correcting period $T_{SET}$, the voltage potential of node A is held in the voltage potential $V_h'$ after the change.

Next, in 1 horizontal scanning period (1 H) commenced from the timing t1, the first half corresponds to the correcting period $T_{SET}$ and the latter half to the program period $T_{WRT}$. In the first-half correcting period $T_{SET}$, the Y driver 14 sets the control signal $G_{SET-i}$ to H level, while the control signal $G_{EL-i}$ to L level in the same manner as above, whereby the driving transistor 210 acts as a diode and in addition, the scanning signal $G_{WRT-i}$ is set to H level. Herewith the voltage potential Vg of node A is raised still higher than the voltage potential $V_h'$ having been held in the holding period $T_H$ shown above, whereby the potential Vg sufficiently approaches the voltage potential '$V_{EL}-V_{th}$' by a plurality of correcting periods.

Figure 7:
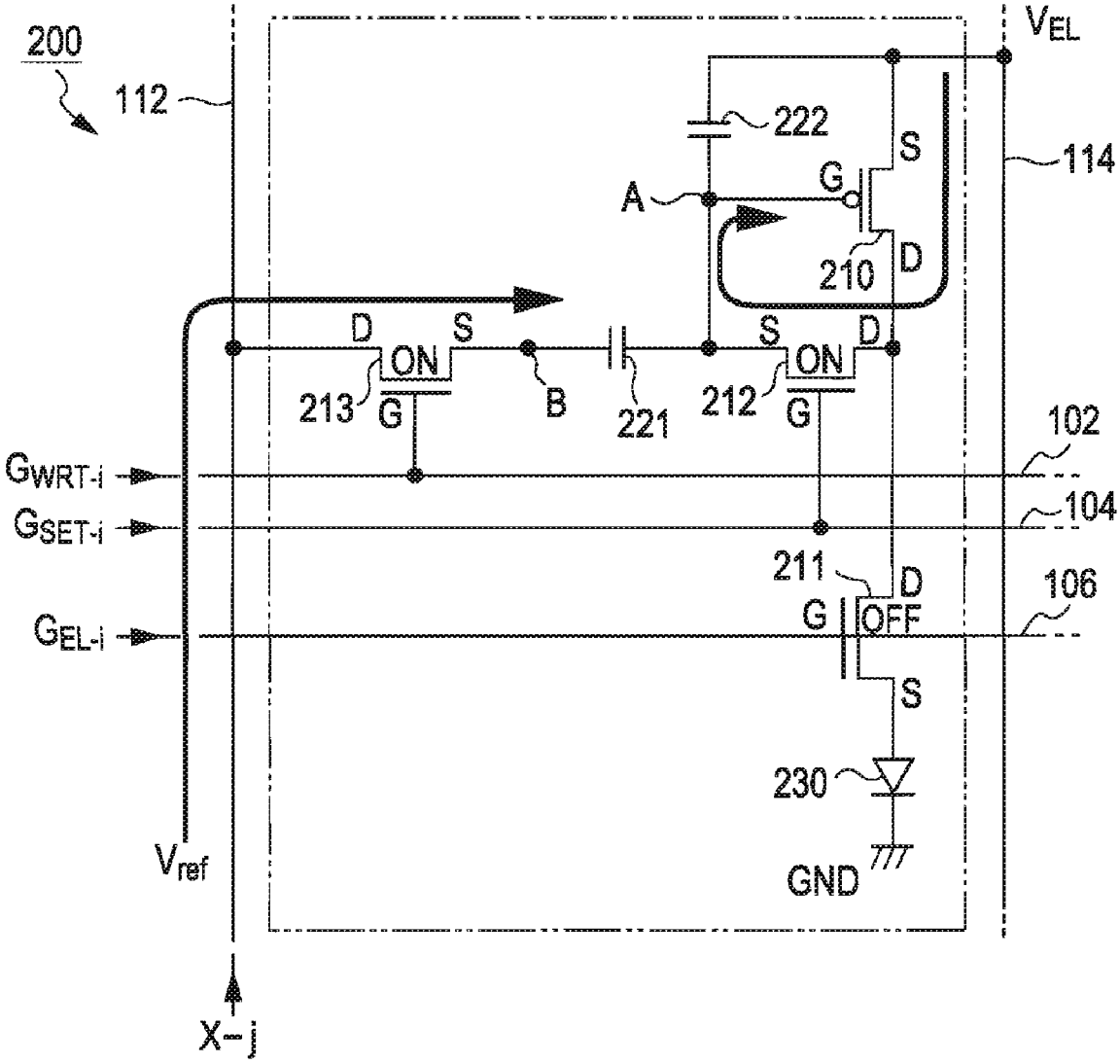
FIG. 7 is an operation explanatory view of the pixel circuit.

Further, in the pixel circuit 200, the transistor 213 is turned on by the scanning signal $G_{WRT-i}$ of H level as shown in FIGS. 7. And, in the first half correcting period $T_{SET}$ of the 1 horizontal scanning line (1 H), that is, the last correcting period $T_{SET}$, the X driver 16 supplies the reference voltage $V_{ref}$ to the data line 112 of row j. Herewith, the reference $V_{ref}$ as the initialization voltage is supplied to node B via the transistor 213, whereby the voltage potential Vq of the node B is fixed to the reference voltage $V_{ref}$.

Figure 8:
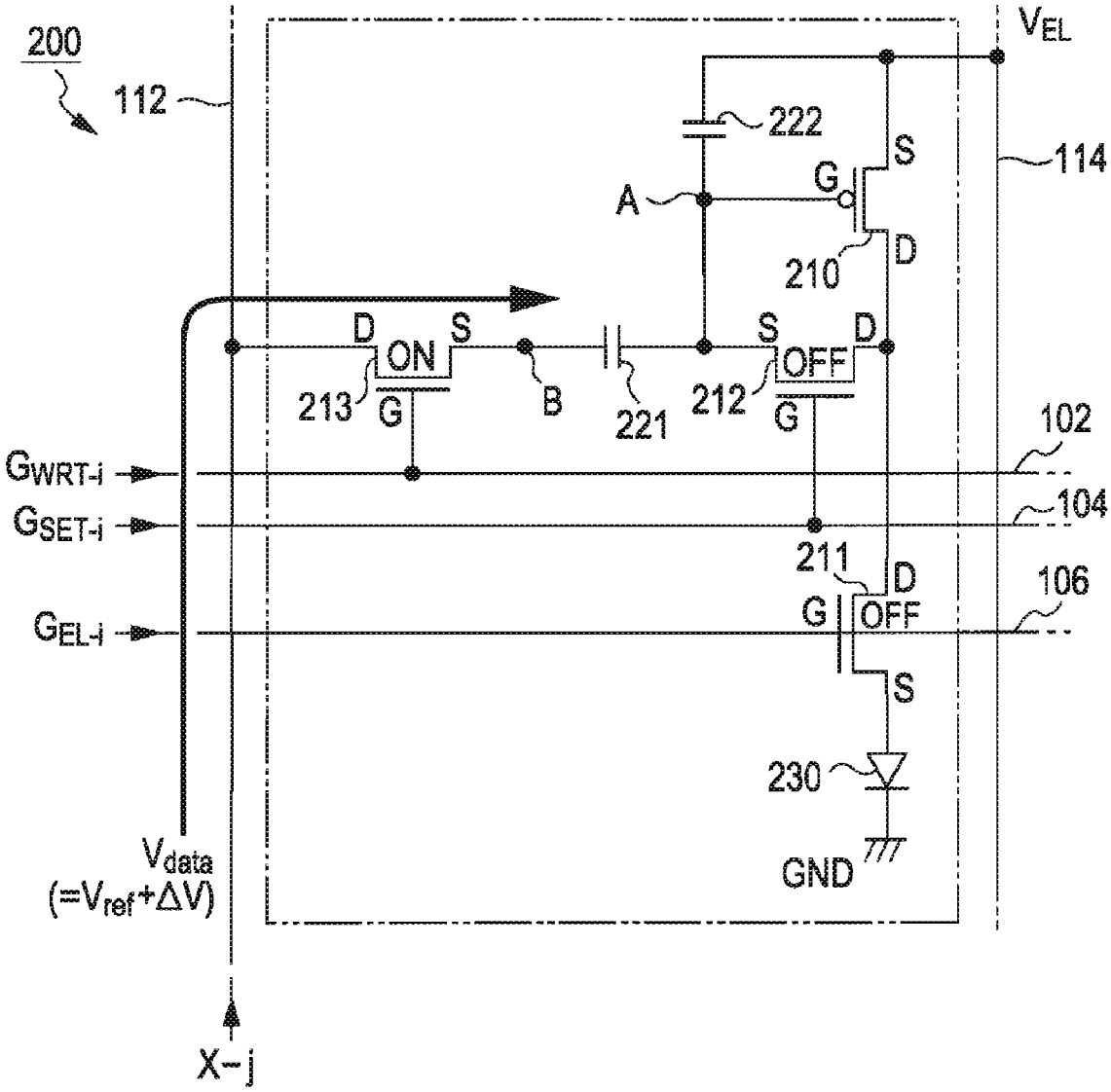
FIG. 8 is an operation explanatory view of the pixel circuit.

Next, in the latter-half program period $T_{WRT}$, the scanning signal $G_{WRT-i}$ keeps H level, so that the control signals $G_{SET-i}$ and $G_{EL-i}$ become L level. Accordingly, as shown in FIG. 8, the transistor 213 is turned on, while the transistors 211 and 212 are off.

Further, in the program period $T_{WRT}$, the X driver 16 supplies the data signal X (i, j) of the voltage corresponding to the gradation of the pixel of i lines×j rows to the data line 112 of row j. If the data voltage of the data signal X (i, j) corresponding to the gradation to be displayed is set as $V_{data}$, the $V_{data}$ is given by the following formula (a).

$$V_{data}=(V_{ref}+\Delta V) \quad \text{(a)}$$

Further, in case that it is designated that the pixel has the maximum gradation, 'the data voltage $V_{data}=0$', that is, '$\Delta V=-V_{ref}$', as the dark gradation is continuously designated, the data voltage $V_{data}$ increases ($\Delta V$ decreases), whereby the pixel is designated to the black of the minimum gradation, 'the data voltage $V_{data}=V_{EL}$', that is, '$\Delta V=-V_{EL}$'. Therefore, the voltage potential Vq of node B fluctuates only by $\Delta V$ from the correcting period $T_{SET}$ just before the program period $T_{WRT}$.

Meanwhile, in the program period $T_{WRT}$, in the pixel circuit 200, since the transistor 212 is turned off, the node A is held by the capacitor 222. As the result, the voltage potential Vg of node A drops from the voltage potential $V_{EL}-V_{th}$ in the correcting period $T_{SET}$ just before the program period $T_{WRT}$ by the amount distributing the voltage variations ΔV by the capacitor ratio in node B.

Specifically, when the capacitance value of the capacitor 221 is designated to Ca and the capacitance value of the capacitor 222 is designated to Cb, node A fluctuates from the voltage potential $V_{EL}-V_{th}$ by 'ΔV·Ca/(Ca+Cb)', whereby the voltage potential Vg of node A is given by the following formula.

$$Vg=V_{EL}-V_{th}-\Delta V\cdot Ca/(Ca+Cb) \quad \text{(b)}$$

Next, in the subsequent 1 horizontal scanning period (1 H), the Y driver 14 sets the scanning signal $G_{WRT-i}$, and the control signals $G_{SET-i}$ and $G_{EL-i}$ to L level. As the result, in the pixel circuit 200, the transistor 213 is turned off, but since the holding state in the capacitor 221 is not changed, the voltage potential Vg is held by the value given In the formula (b) as shown in FIG. 6.

Figure 9:
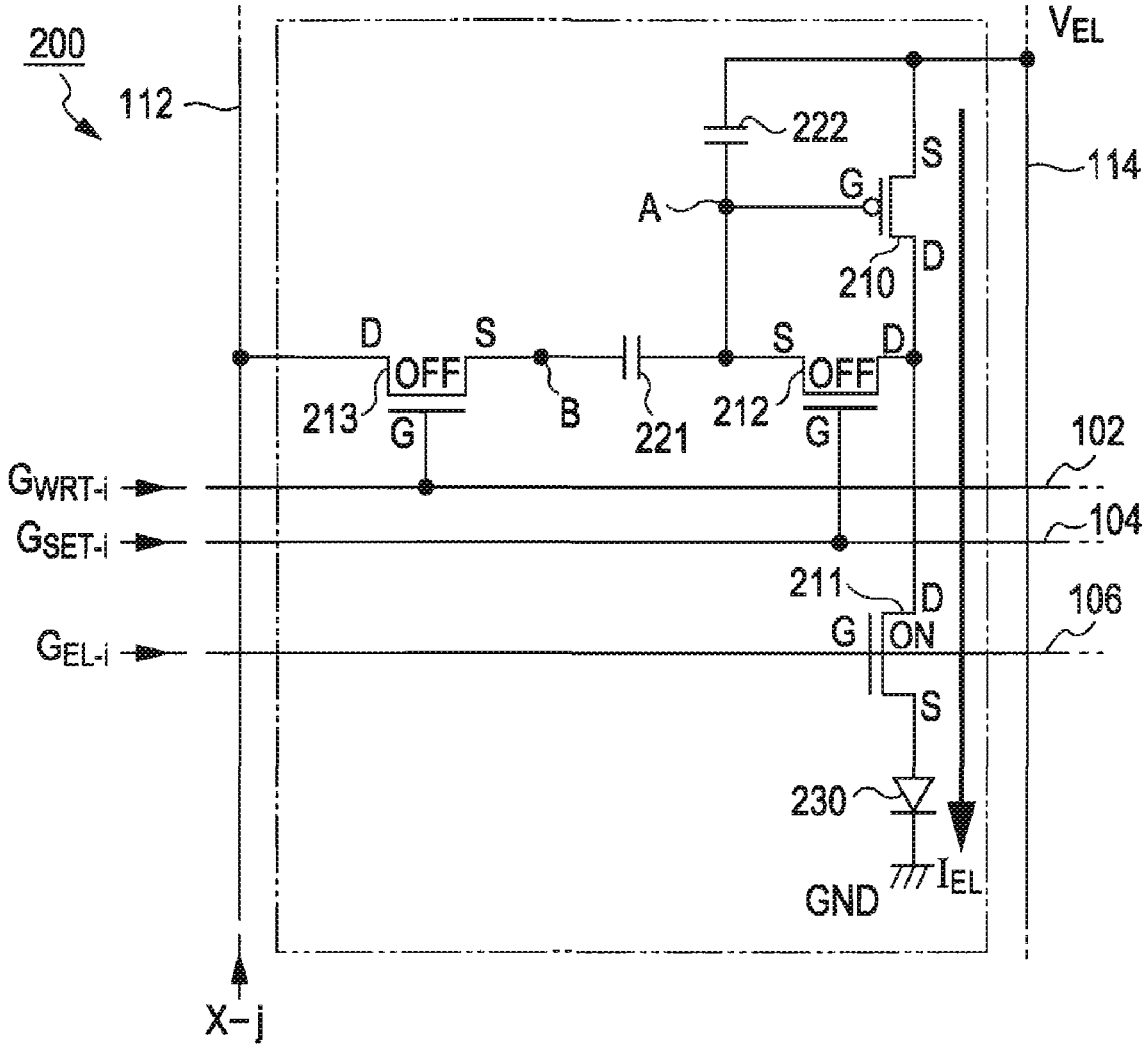
FIG. 9 is an operation explanatory view of the pixel circuit.

And, after the subsequent 1 horizontal scanning period (1 H) elapses, the Y driver 14 sets the control signal $G_{EL-i}$ to H level. As the result, the transistor 211 is turned on as shown in FIG. 9. Herewith, in the OLED element 230, the current $I_{EL}$ corresponding to the gate-source voltage of the driving transistor 210 flows on the path in order of the feeder line 114, driving transistor 210, transistor 211, OLED element 230 and ground GND. As the result, the OLED element 230 continuously light-emits in the brightness corresponding to the current $I_{EL}$.

In the light-emitting period, the current $I_{EL}$ which flows on the OLED 230 is determined by the conduction state between the source and drain of the driving transistor 210 and the conduction state is established by the voltage potential of node A. Here since the gate voltage viewed from the source of the driving transistor 210 is '$-(Vg-V_{EL})$', the current $I_{EL}$ is given by:

$$I_{EL}=(\beta/2)(V_{EL}-Vg-V_{th})^2 \quad \text{(c)}$$

Further, in this formula, β is the gain coefficient of the driving transistor 210.

Here, the formulas (a) and (b) are assigned to the formula (c) whereby the formula (d) can be given by:

$$I_{EL}=(\beta/2)\{K\cdot\Delta V\}^2 \quad \text{(d)}$$

However, k is an integral number and k=Ca/((Ca+Cb). As shown in the formula (d), the current $I_{EL}$ which flows on the OLED element 230 depends on the difference ΔV ($=V_{data}-V_{ref}$) between the data voltage $V_{data}$ and the reference voltage $V_{ref}$ without the dependence on the threshold voltage $V_{th}$ of the driving transistor 210.

And, if the light-emitting period $T_{EL}$ is continued only in a predetermined period, the Y driver 14 sets the control signal $G_{EL-i}$ to L level. Herewith, since the transistor 211 is turned off, the current path is interrupted, whereby the OLED element 230 is turned off.

As described above, in this embodiment, since the correcting period $T_{SET}$ which corrects the threshold voltage characteristic of the driving transistor 210 is assigned to a plurality of horizontal scanning periods, the correcting period $T_{SET}$ can be enough long, whereby the unbalance of the light-emitting luminance can be remarkably improved.

In addition, the scanning line 102 needs to be selected sequentially every the horizontal scanning period so that the data voltage $V_{data}$ and the reference voltage $V_{ref}$ can be input to each pixel circuit 200, but both cannot be simultaneously supplied to one data line 112. In this embodiment, after one horizontal scanning period is divided into a first period and a second period, since the initialization period $T_{INI}$ and the correcting period $T_{SET}$ are assigned to the first period and the program period is assigned to th program period $T_{WRT}$ is assigned to the second period, the time-sharing operation can be implemented. Herewith, the correcting period $T_{SET}$ can be dispersed in the plurality of scanning periods.

Moreover, since the reference voltage $V_{ref}$ is supplied via the data line 112, it is not necessary that the exclusive wire is provided to supply the reference voltage $V_{ref}$. As the result, since the wiring structure can be simple and easy, the aperture ratio also can be improved.

Modified Embodiments

The present invention is not confined only to the above-described embodiments, for example, various modifications described below are available.

Figure 10:
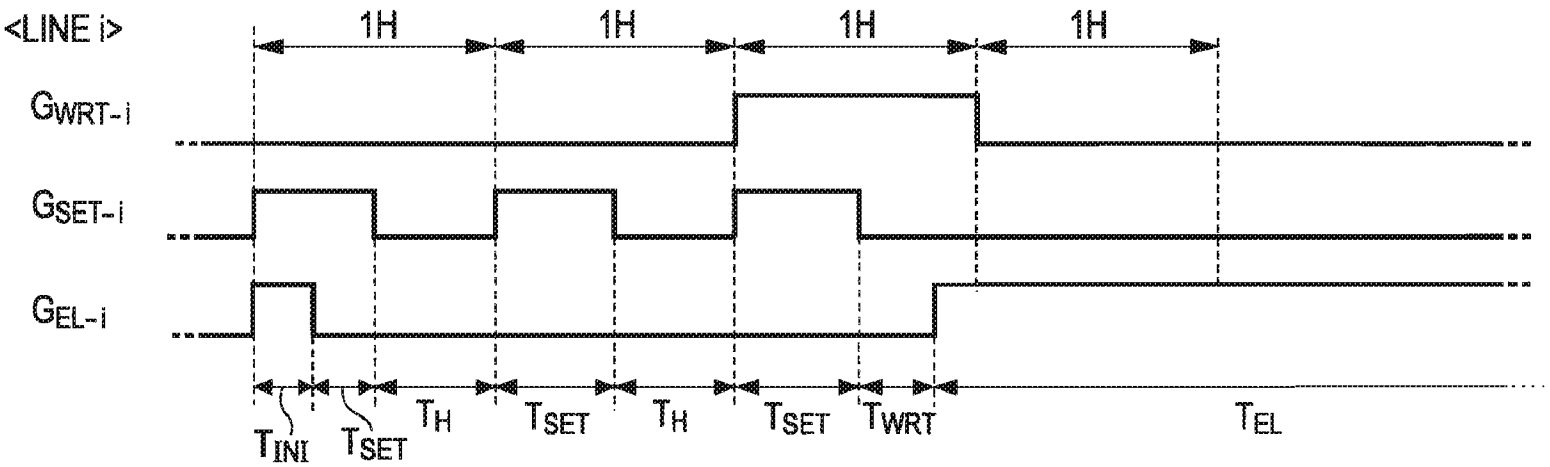
FIG. 10 is a timing chart showing the commencement of a light-emitting period $T_{EL}$ in a modified embodiment.

1. In the above-mentioned embodiment, the commencement of the light-emitting period $T_{EL}$ coincides with the commencement of the horizontal scanning period as shown in FIG. 3, but it is not necessary that the commencement of the light-emitting period $T_{EL}$ coincides with the commencement of the horizontal scanning period as shown in FIG. 10. If the program period $T_{WRT}$ is terminated in the middle of the horizontal scanning period, the light-emitting period may be commenced just after the program period $T_{WRT}$. In this case, it is not necessary that the holding period $T_H$ is established between the program period $T_{WRT}$ and the light-emitting period $T_{EL}$.

Figure 11:
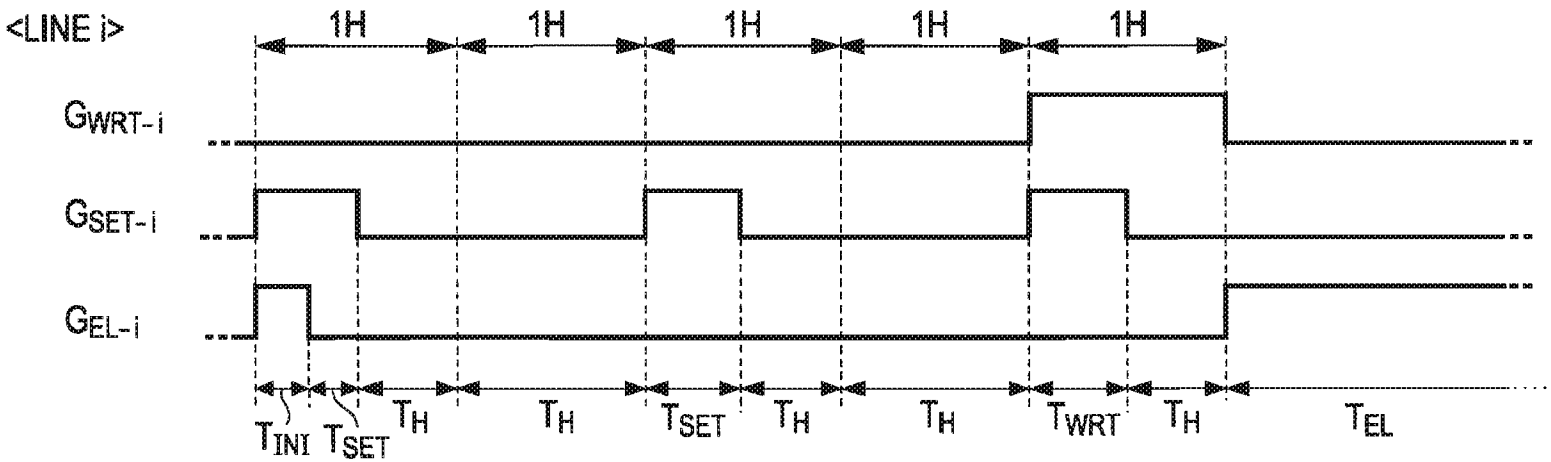
FIG. 11 is a timing chart showing the disposition of a correcting period $T_{SET}$ in a modified embodiment.

2. In the above-mentioned embodiment, the correcting period $T_{SET}$ is disposed in each horizontal scanning period from the horizontal scanning period to which the initialization period can be assigned to the horizontal scanning period to which the program period $T_{WRT}$ can be assigned as shown in FIG. 3, but the invention is not confined only to that. That is, the correcting period $T_{SET}$ may be disposed in a part of horizontal scanning period of each horizontal scanning period from the horizontal scanning period to which the initialization period $T_{INI}$ can be assigned to the horizontal scanning period to which the program period $T_{WRT}$ can be assigned as shown in FIG. 11. That is, when the first half (the first period) of the horizontal scanning period between any correcting period $T_{SET}$ of the plurality of correcting periods $T_{SET}$ and the subsequent correcting period $T_{SET}$ is set as an idle period, the unbalance of the driving current output from the driving transistor 210 is not corrected in the idle period. In this case, the correcting period $T_{SET}$ may be assigned to every other horizontal scanning period, but such length can be sufficiently obtained. Consequently, in this case, the unbalance of the light-emitting luminance can be remarkably improved.

Figure 12:
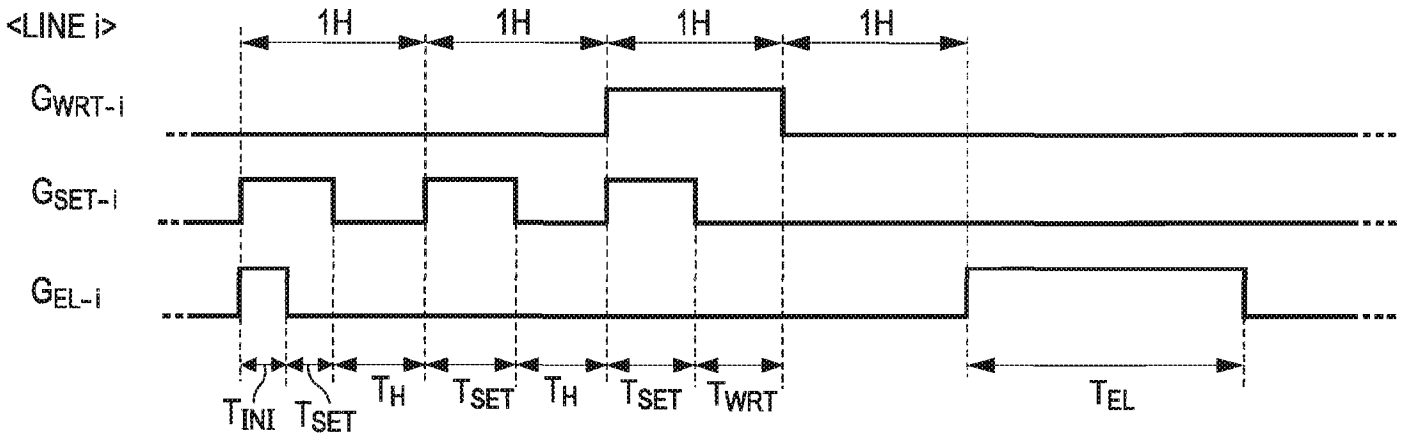
FIG. 12 is a timing chart showing the termination of a light-emitting period $T_{EL}$ in a modified embodiment.

3. In the above-mentioned embodiment, although the termination time of the light-emitting period $T_{EL}$ was not apparent as shown in FIG. 3, in case when the subsequent initialization period $T_{INI}$ is not yet commenced, the light-emitting period may be terminated at any time as shown in FIG. 12. In this case, the length of the light-emitting period $T_{EL}$ may be adjusted in correspondence with the brightness of the whole screen. More specifically, if the illuminance of the outside light is high, the length of the light-emitting period $T_{EL}$ increases, whereby the whole screen may be brighten, while if the illuminance of the outside light is low, the length of the light-emitting period $T_{EL}$ decreases, whereby the whole screen may be darkened. As described above, the length of the light-emitting period $T_{EL}$ is adjusted in correspondence with the brightness of the environments whereby the power consumption can be reduced while good viewability of the screen is maintained.

Figure 13:
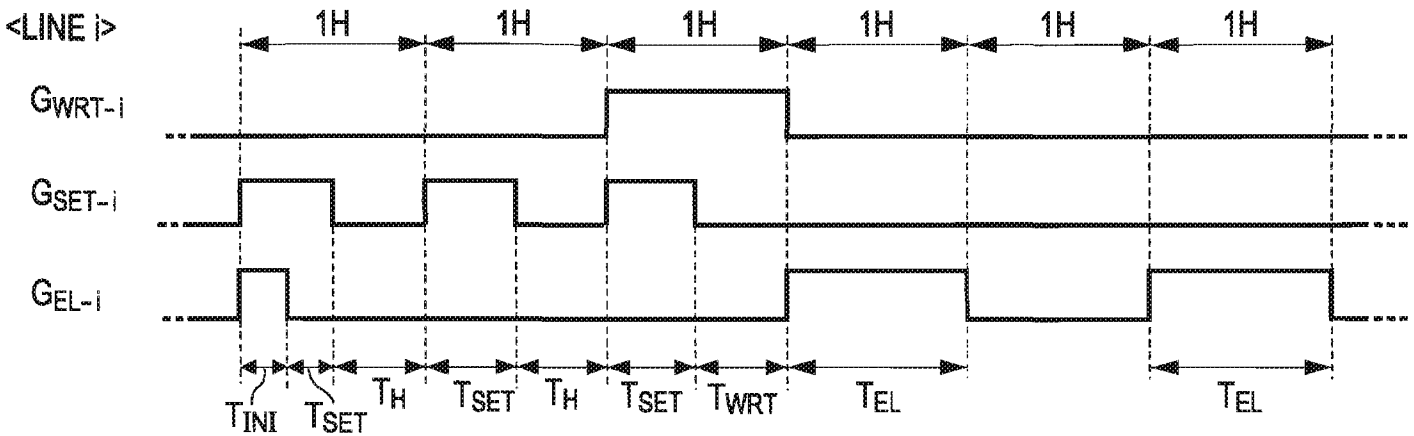
FIG. 13 is a timing chart showing the distributive disposition of a light-emitting period $T_{EL}$ in a modified embodiment.

4. In the above-mentioned embodiment, the light-emitting period $T_{EL}$ is subsequent as shown in FIG. 3, but the invention is not confined only to that. The light-emitting period $T_{EL}$ may be discontinuously disposed as shown in FIG. 13. As described above, if the light-emitting period $T_{EL}$, is distributively disposed in the light-emitting period $T_{EL}$ of one frame, the flicker can be suppressed.

Figure 4:
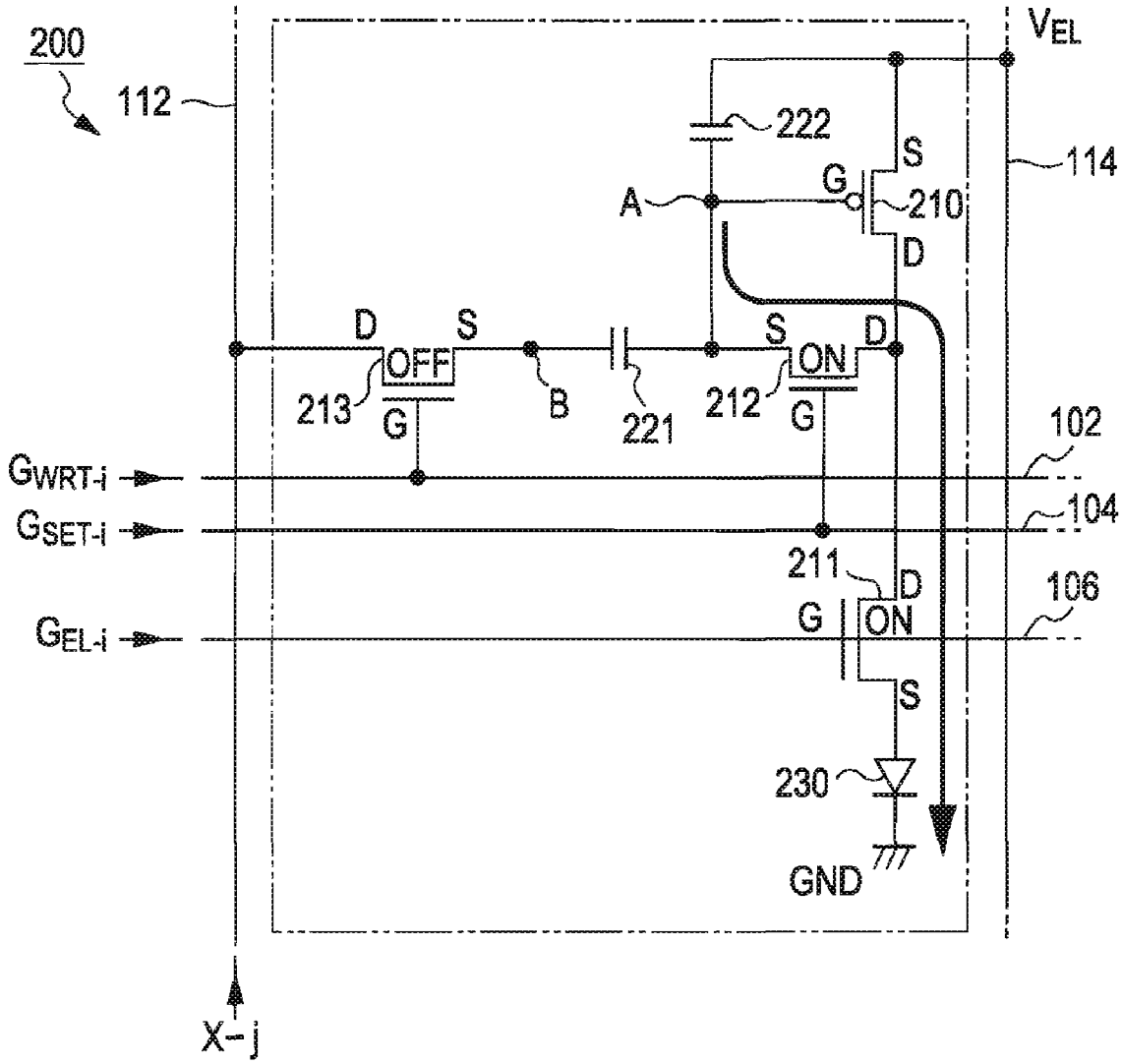
FIG. 4 is an operation explanatory view of the pixel circuit.
Figure 14:
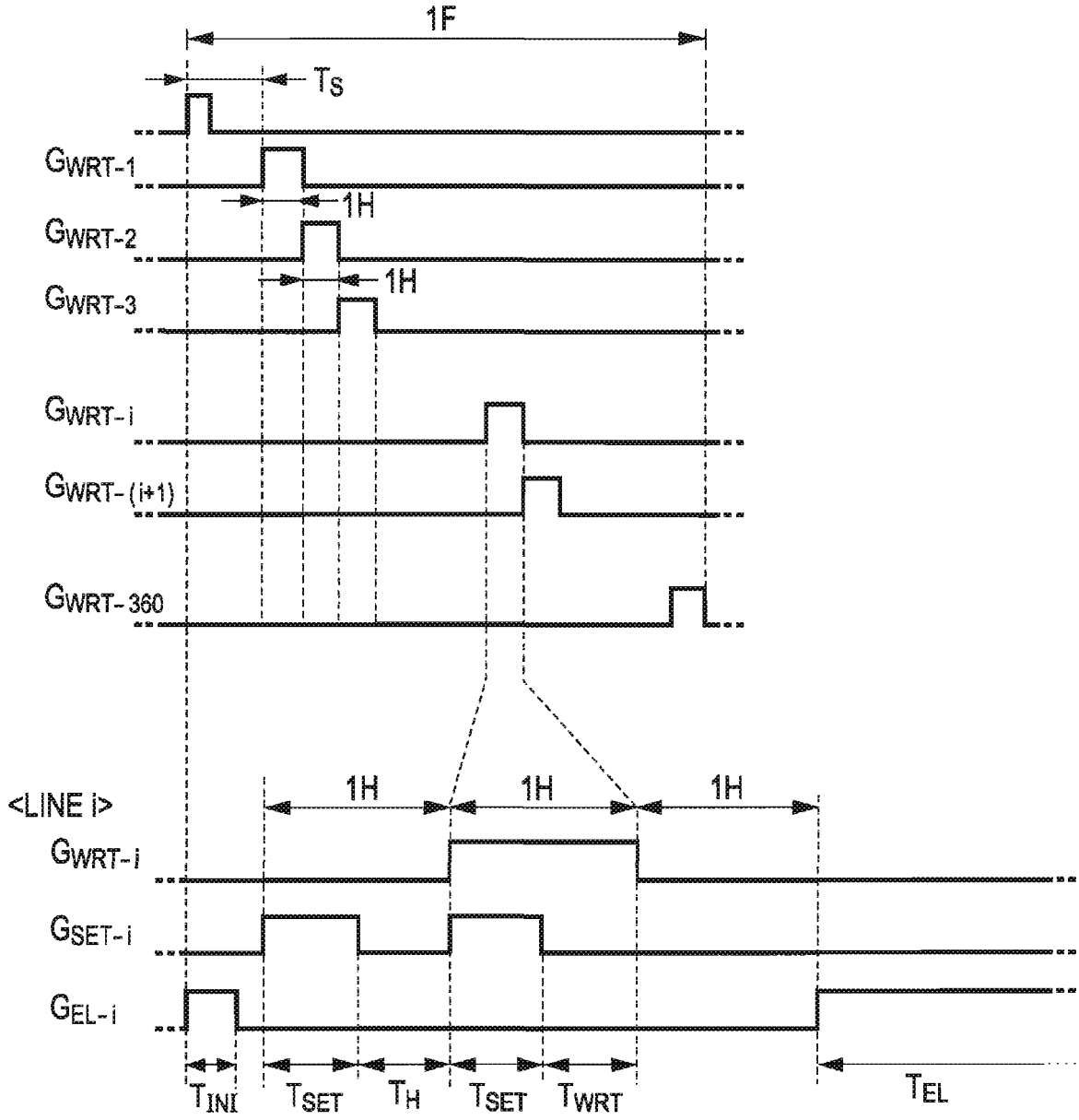
FIG. 14 is a timing chart showing the disposition of a standardized initialization period $T_{INI}$ in a modified embodiment.

5. In the above-mentioned embodiment, the Y driver 14 supplies the control signals $G_{EL-1}$ TO $G_{EL-360}$ so that the initialization period $T_{INI}$ is sequentially shifted to each of a plurality of control lines 106 only in 1 horizontal scanning period as shown in FIG. 3, but the invention is not confined only to that. The initialization period $T_{INI}$ which is common to all pixel circuits 200 may be provided once a frame as shown in FIG. 14. In that case, as shown in FIG. 4, since the voltage potential of node A drops, even if the initialization period $T_{INI}$ is common to all pixel circuits 200, the high voltage $V_{EL}$ does not drop. The Y driver 14 can be easily and simply constructed by this standardization.

6. In the above-mentioned embodiment, a p-channel driving transistor 210 is used in the pixel circuit 200, but in stead of the p-channel driving transistor, an n-channel may be used.

Figure 15:
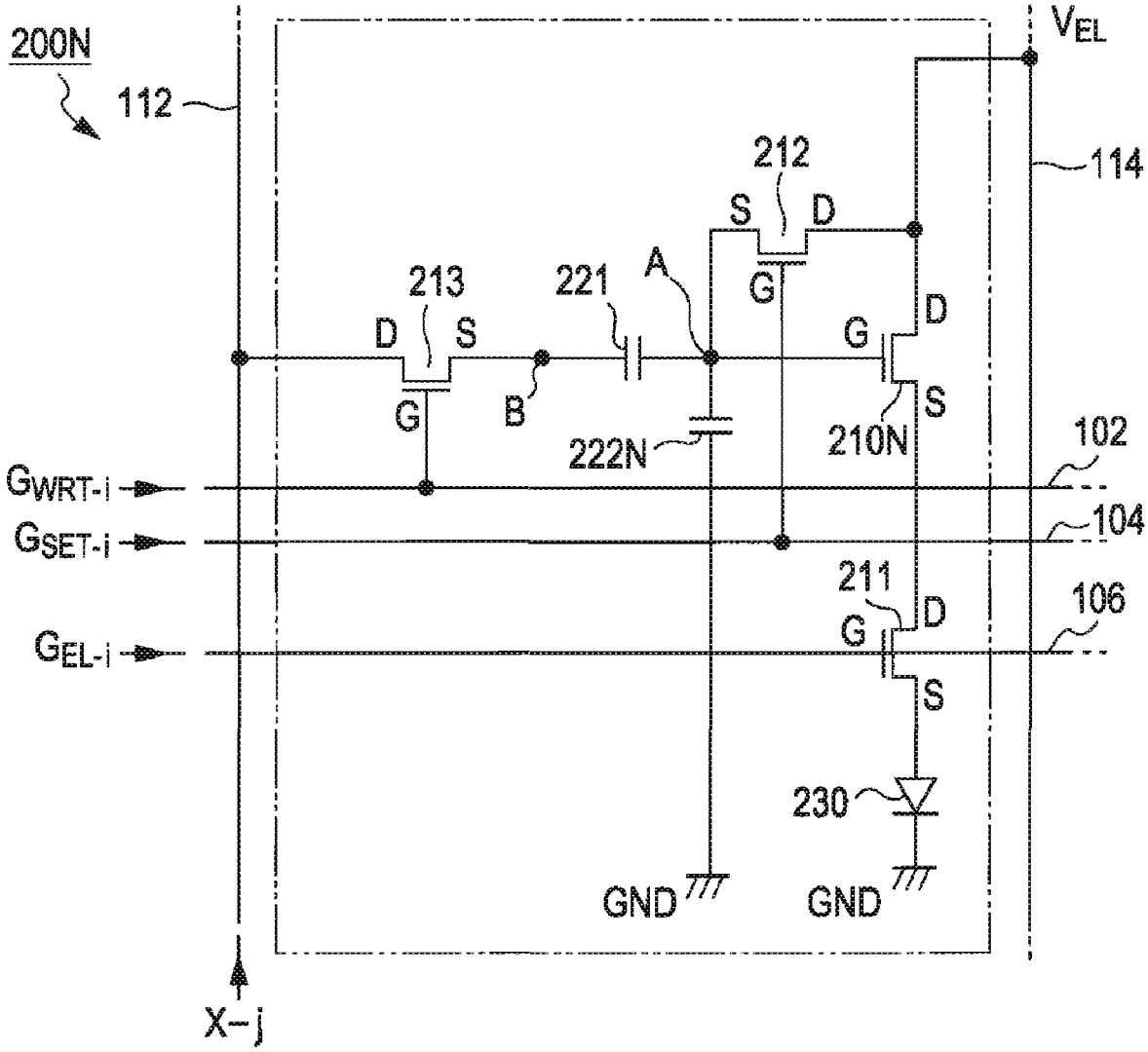
FIG. 15 is a circuit diagram showing the construction of a pixel circuit 200 in a modified embodiment.

FIGS. 15 is a circuit diagram of a pixel circuit 200N that uses an n-channel driving transistor 210N. In this pixel transistor, it is desirable that the capacitor element 222N is provided between the driving transistor 210N and the ground GND.

Figure 16:
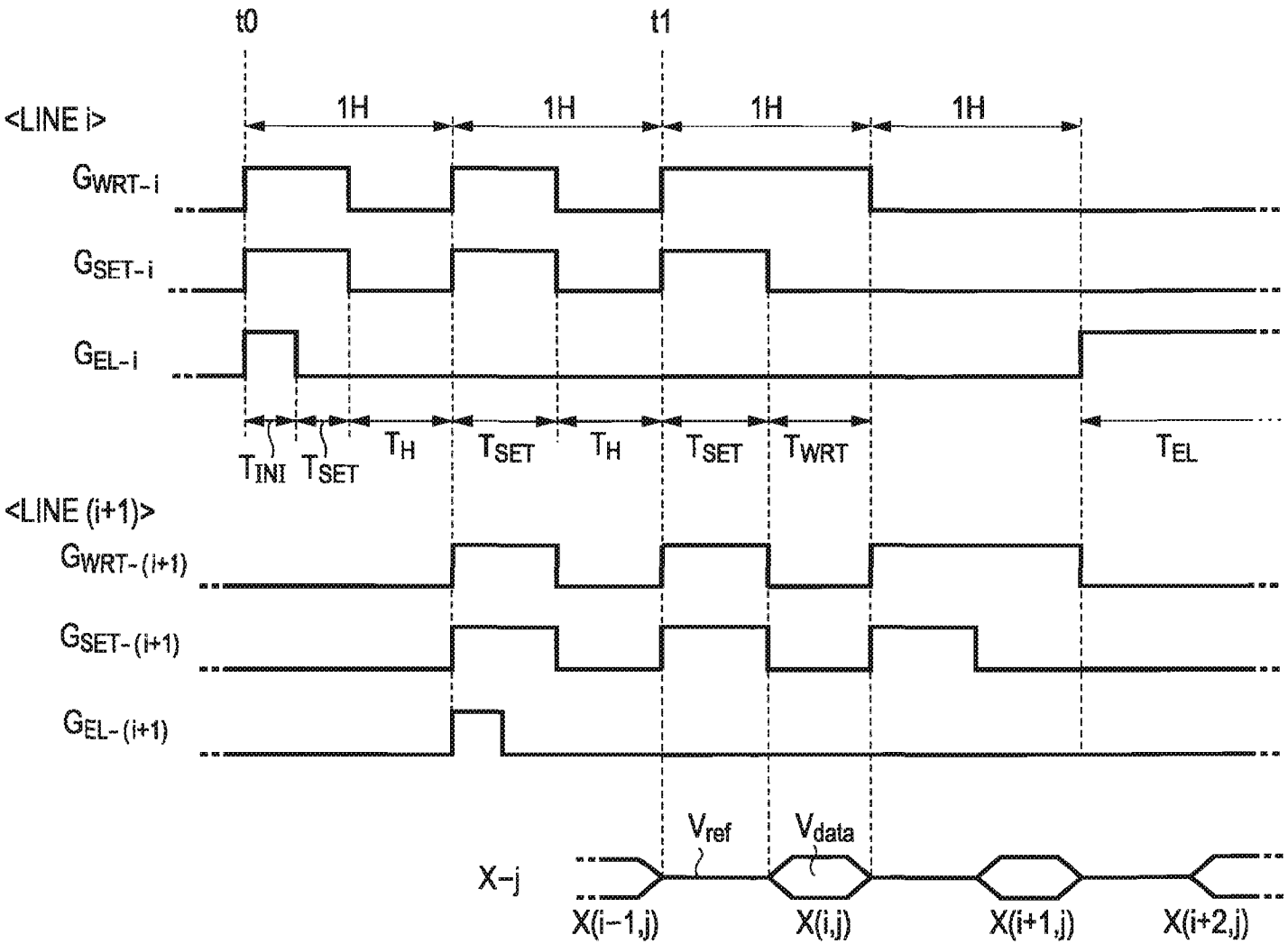
FIG. 16 is a timing chart the relationship between a correcting period $T_{SET}$, an initialization period $T_{INI}$ and a correcting period $T_{SET}$, and a scanning signal $G_{WRT}$ in a modified embodiment.

7. In the above-mentioned embodiment and modified embodiment, the scanning signal $G_{WRT-i}$ is active in the last correcting period $T_{SET}$ of the plurality of correcting periods $T_{SET}$, whereby the reference voltage $V_{ref}$ is taken up from the data line 112 via the transistor 213 as shown in FIG. 3, and FIGS. 10 to 14. In addition, in the same manner as the initialization period $T_{INI}$, the transistor 213 is turned off, whereby the pixel circuit 200 is separated by the data line 112. However, as shown in FIG. 16, in a plurality of correcting period $T_{SET}$ and the initialization period $T_{INI}$, the reference voltage $V_{ref}$ is taken up to the pixel circuit 200 when the scanning signal $G_{WRT-i}$ is active. In this case, in the first period of the horizontal scanning period which is a unit period, two or more scanning lines 102 of a plurality of scanning lines 102 are selected while the reference voltage $V_{ref}$ is supplied to the data line 112. Thus, the reference voltage $V_{ref}$ is taken up to a plurality of pixel circuits 200 connected to the scanning lines. Further, In the second period in the latter half of the unit period, one scanning line of the plurality of scanning lines 102 is selected, whereby the writing operation is implemented on the plurality of pixel circuits 200 connected to the selected scanning line 102.

That is, the first period in which the reference voltage $V_{ref}$ is supplied and the second period in which the data voltage $V_{data}$ are alternatively repeated. In the first period, the correcting or initialization operation for the plurality of scanning lines 102 and in the second period, one scanning line 102 is selected and the input operation is implemented. In addition, the first period is divided into the preceding first period in which the data voltage $V_{data}$ is input into the pixel circuit 200 connected to any scanning line 102 is implemented and the subsequent first period in which the data voltage $V_{data}$ is input into the subsequent scanning line 102. A second period for the correcting or initialization exists between both periods.

As shown above, in the plurality of correcting periods $T_{SET}$ and initialization periods $T_{INI}$, if the reference voltage $V_{ref}$ is taken up into the pixel circuit 200, the voltage of node B can be fixed to the reference voltage $V_{ref}$ in such periods. Only in the last correcting period $T_{SET}$, if the reference voltage $V_{ref}$ is supplied to node B, since charges move between the capacitor element 221 and the capacitor element 222 when the last correcting period $T_{SET}$ is commenced, the voltage potential of node A is often deviated at that time. Correspondingly, in the plurality correcting periods $T_{SET}$ and initialization periods $T_{INI}$, if the reference voltage $V_{data}$ is taken up to the pixel data 200, such disadvantage does not turn up and the proper correcting is available.

Electronic Apparatus

Figure 17:
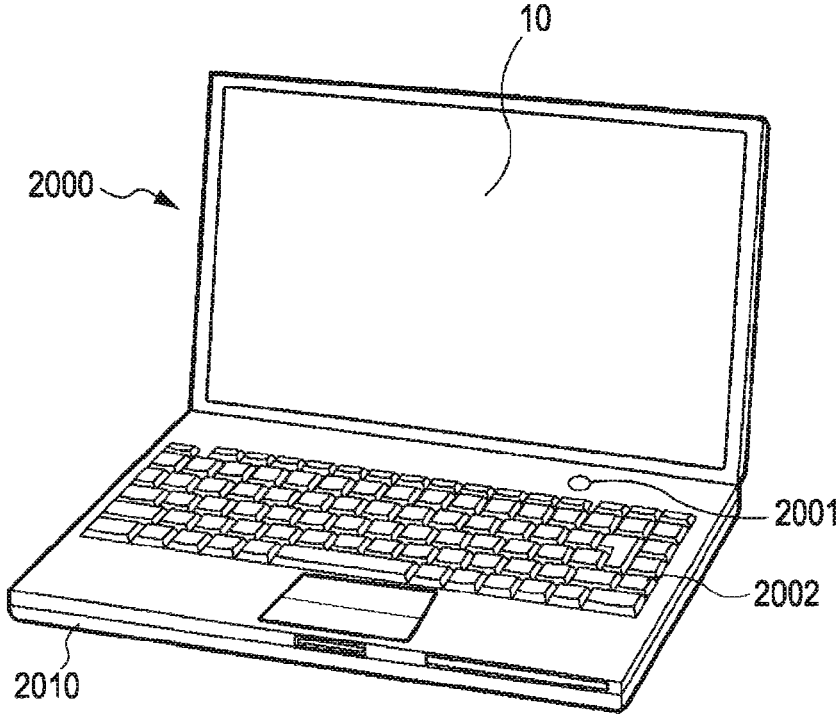
FIG. 17 shows a personal computer using the light-emitting device.

Next, the electronic apparatus applying a light-emitting device 10 related to the above-mentioned embodiment will be described. FIG. 17 shows the construction of a mobile-type personal computer applying a light-emitting device 10. A personal computer 2000 has a body part 2010 with the light-emitting device 10 as a display unit. A power switch 2001 and a keyboard 2002 are provided in the body part 2010. The light-emitting device 10 uses the OLED element 230, whereby the screen with wide viewing angle and good viewability can be displayed.

Figure 18:
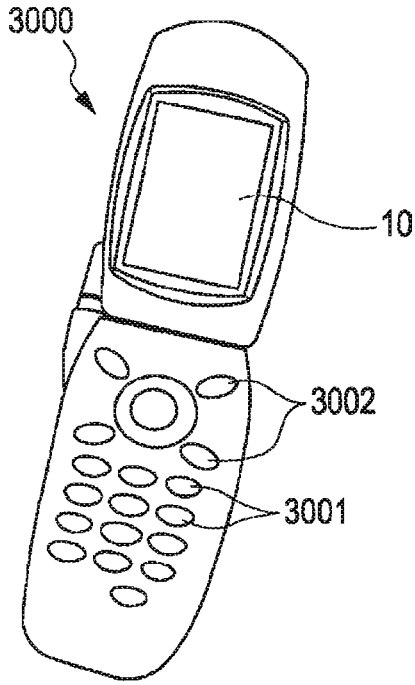
FIG. 18 shows a cellular phone using the light-emitting device.

FIG. 18 shows the construction of a cellular phone applying a light-emitting device 10. A cellular phone 3000 has a plurality of manual operation buttons 3001, a scroll button 3002 and the light-emitting device 10 as a display unit. The screen displayed on the light-emitting device 10 is scrolled by operating the scroll button 3002.

Figure 19:
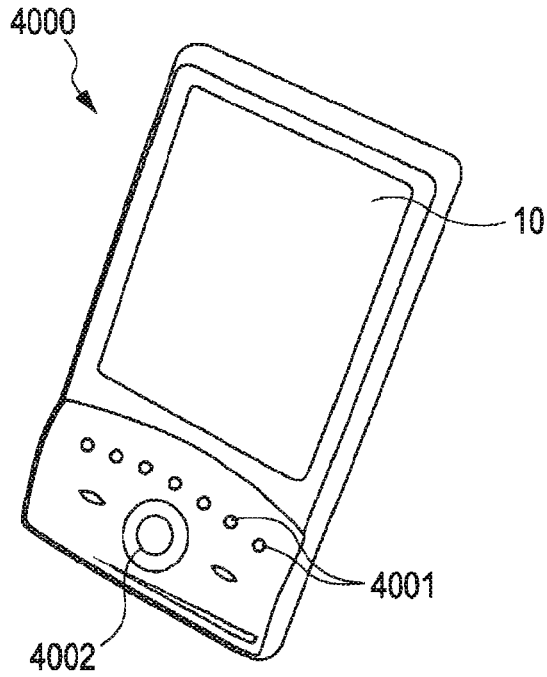
FIG. 19 shows an information terminal using the light-emitting device the light-emitting device.

FIG. 19 shows the construction of a PDA (Personal, Digital Assistant) applying a light-emitting device 10. The PDA 4000 has a plurality of manual operation buttons 4001, a power switch 4002 and the light-emitting device 10 as a display unit. A variety of information such as a address list or a schedule book are displayed on the light-emitting device 10 by operating the power switch 4002.

Further, electronic apparatuses applying the light-emitting device 10 include apparatuses having a digital camera, an LCD TV, a viewfinder-type video tape recorder, a monitor direct-view-type video tape recorder, a car navigation device, a pager, an electronic databook, an electronic calculator, a sword processor, a workstation, a video phone, a POS terminal and a touch panel in addition to the apparatuses shown in FIGS. 10 to 18. And, the above-mentioned light-emitting device 10 is applicable to the display unit of various electronic apparatuses. In addition, the light-emitting device 10 may be applicable as a light source of a printing product used to form images, characters or the like indirectly by radiating light to a photo-conducted object as well as the display unit of the electronic apparatus which displays images, characters or the like directly.

What is claimed is:

1. A light-emitting device, comprising:

a plurality of scanning lines;

a plurality of data lines that intersect the plurality of scanning lines;

a plurality of pixel circuits arranged corresponding to the intersections of the scanning lines and the data lines, each pixel circuit including:

a light-emitting element;

a driving transistor that controls an amount of a driving current flowing to the light-emitting element in a light-emitting period of a frame in which the driving current is supplied to the light-emitting element after a writing period is terminated in the frame; and a write transistor being a single transistor controlled by a first scanning line of the plurality of scanning lines, wherein a plurality of sequential horizontal scanning periods precede the light-emitting period of the lighting emitting element in the frame, and each horizontal scanning period has a first period half and a second period half immediately following the first period half, wherein the plurality of sequential horizontal scanning periods correspond with the writing period and at least two correction periods preceding the writing period, and wherein the writing period corresponds with one horizontal scanning period in which the write transistor is maintained in an on state for the first period half and the second period half followed by one horizontal scanning period in which the write transistor is maintained in an off state for the first period half and the second period half, a first half of the first period half of the first of the plurality of sequential horizontal scanning periods is an initialization period and in the initialization period, an EL transistor is turned on and a gate potential of the driving transistor is set to an initialization potential, in the at least two correction periods corresponding with horizontal scanning periods preceding the writing period the first scanning line of the plurality of scanning lines and a first set line are selected in the first period half of the corresponding horizontal scanning periods, and a data line of the plurality of data lines supplies a reference voltage to a pixel circuit connected to the first scanning line such that a voltage is generated in the pixel circuit for compensating a threshold voltage of the driving transistor, in the writing period after the correction periods, the first scanning line of the plurality of scanning lines is selected, and the data line supplies to the pixel circuit a data signal corresponding to a brightness to be emitted by the light-emitting element of the pixel circuit, the data line supplies the reference voltage and the data signal to the pixel circuit via the write transistor, and the initialization potential is a substantially ground potential raised by a threshold voltage of the light-emitting element.

2. An electronic device, comprising:

the light-emitting device as set forth in claim 1.

3. A method of driving a light-emitting device, the light-emitting device having a plurality of scanning lines, a plurality of data lines that intersect with the plurality of scanning lines, and a plurality of pixel circuits arranged corresponding to the intersections of the scanning lines and data lines, each pixel circuit having a light-emitting element, a driving transistor that controls an amount of a driving current flowing to the light-emitting element in a light-emitting period of a frame in which the driving current is supplied to the light-emitting element after a writing period is terminated in the frame, and a write transistor being a single transistor controlled by a first scanning line of the plurality of scanning lines, the method comprising:

in an initialization period, turning on an EL transistor and setting a gate potential of the driving transistor to an initialization potential;

a plurality of sequential horizontal scanning periods precede the light-emitting period of the light-emitting element in the frame, and each horizontal scanning period has a first period half and a second period half immediately following the first period half, wherein the plurality of sequential horizontal scanning periods correspond with the writing period and at least two correction periods preceding the writing period, and wherein the writing period corresponds with one horizontal scanning period in which the write transistor is maintained in an on state for the first period half and the second period half followed by one horizontal scanning period in which the write transistor is maintained in an off state for the first period half and the second period half, in the at least two correction periods corresponding with horizontal scanning periods preceding the writing period, selecting the first scanning line of the plurality of scanning lines and a first set line in the first period half of the corresponding horizontal scanning periods, and supplying a reference voltage from a data line of the plurality of data lines to a pixel circuit connected to the first scanning line such that a voltage is generated in the pixel circuit for compensating a threshold voltage of the driving transistor; and in the writing period after the correction periods, selecting the first scanning line of the plurality of scanning lines, and supplying from the data line a data signal corresponding to a brightness to be emitted by the light-emitting element of the pixel circuit, wherein a first half of the first period half of the first of the plurality of sequential horizontal scanning periods is the initialization period, the data line supplies the reference voltage and the data signal to the pixel circuit via the write transistor; and the initialization potential is a substantially ground potential raised by a threshold voltage of the light-emitting element.

4. A light-emitting device, comprising:

a plurality of scanning lines;

a plurality of data lines that intersect the plurality of scanning lines;

a plurality of pixel circuits arranged corresponding to intersections of the scanning lines and the data lines, each pixel circuit including:

a light-emitting element;

a driving transistor that controls an amount of a driving current flowing to the light-emitting element in a light-emitting period of a frame; and a write transistor being a single transistor controlled by a first scanning line of the plurality of scanning lines, wherein in an initialization period, an EL transistor is turned on and a gate potential of the driving transistor is set to an initialization potential;

a plurality of sequential horizontal scanning periods precede the light-emitting period of the light-emitting element in the frame, and each horizontal scanning period has a first period half and a second period half immediately following the first period half, wherein the plurality of sequential horizontal scanning periods correspond with a writing period and at least two correction periods preceding the writing period, and wherein the writing period corresponds with one horizontal scanning period in which the write transistor is maintained in an on state for the first period half and the second period half followed by one horizontal scanning period in which the write transistor is maintained in an off state for the first period half and the second period half, in the at least two correction periods corresponding with horizontal scanning periods preceding the writing period, which are set after the initialization period and are repeated a plurality of times, a data line of the plurality of data lines supplies a reference voltage to a pixel circuit connected to the first scanning line such that a voltage is generated in the pixel circuit for compensating a threshold voltage of the driving transistor, in the at least two correction periods, the first scanning line and a first set line are selected in the first period half of the corresponding horizontal scanning periods, in the writing period after a last correction period, the first scanning line is selected and the data line supplies to the pixel circuit a data signal corresponding to a brightness to be emitted by the light-emitting element of the pixel circuit in the light-emitting period in which the driving current is supplied to the light-emitting element after the writing period is terminated, a first half of the first period half of the first of the plurality of sequential horizontal scanning periods is the initialization period, the data line supplies the reference voltage and the data signal to the pixel circuit via the write transistor, and the initialization potential is a substantially ground potential raised by a threshold voltage of the light-emitting element.

5. An electronic device, comprising;

the light-emitting device as set forth in claim 4.

6. A method of driving a light-emitting device, the light-emitting device having a plurality of scanning lines, a plurality of data lines that intersect with the plurality of scanning lines, and a plurality of pixel circuits arranged corresponding to the intersections of the scanning lines and the data lines, each pixel circuit having a light-emitting element, a driving transistor that controls an amount of a driving current flowing to the light-emitting element in a light-emitting period of a frame and a write transistor being a single transistor controlled by a first scanning line of the plurality of scanning lines, the method comprising:

in an initialization period, turning on an EL transistor and setting a gate potential of the driving transistor to an initialization potential;

a plurality of sequential horizontal scanning periods precede the light-emitting period of the light-emitting element in the frame, and each horizontal scanning period has a first period half and a second period half immediately following the first period half, wherein the plurality of sequential horizontal scanning periods correspond with a writing period and at least two correction periods preceding the writing period, and wherein the writing period corresponds with one horizontal scanning period in which the write transistor is maintained in an on state for the first period half and the second period half followed by one horizontal scanning period in which the write transistor is maintained in an off state for the first period half and the second period half, in the at least two correction periods corresponding with horizontal scanning periods preceding the writing period, which are set after the initialization period and repeated a plurality of times, supplying a reference voltage from a data line of the plurality of data lines to a pixel circuit connected to the first scanning line such that a voltage is generated in the pixel circuit for compensating a threshold voltage of the driving transistor, selecting the first scanning line and a first set line in the first period half of the horizontal scanning periods corresponding with the at least two correction periods, and in the writing period after a last correction period, the first scanning line is selected and the data line supplies to the pixel circuit a data signal corresponding to a brightness to be emitted by the light-emitting element of the pixel circuit in the light-emitting period in which the driving current is supplied to the light-emitting element after the writing period is terminated, wherein a first half of the first period half of the first of the plurality of sequential horizontal scanning periods is the initialization period, the data line supplies the reference voltage and the data signal to the pixel circuit via the write transistor, and the initialization potential is a substantially ground potential raised by a threshold voltage of the light-emitting element.

7. The light-emitting device according to claim 1, wherein:

in the at least two correction periods, the first scanning line and at least a second scanning line are selected, and the data line supplies the reference voltage to a pixel circuit connected to the first scanning line and supplies the reference voltage to a pixel circuit connected to the second scanning line; and in the writing period, only the first scanning line is selected.

8. The method of driving a light-emitting device according to claim 3, wherein:

in the at least two correction periods, the first scanning line and at least a second scanning line are selected, and the data line supplies the reference voltage to a pixel circuit connected to the first scanning line and supplies the reference voltage to a pixel circuit connected to the second scanning line; and in the writing period, only the first scanning line is selected.

9. The light-emitting device according to claim 4, wherein:

in the at least two correction periods, the first scanning line and at least a second scanning line are selected, and the data line supplies the reference voltage to a pixel circuit connected to the first scanning line and supplies the reference voltage to a pixel circuit connected to the second scanning line;

in the last correction period, the first and second scanning lines are selected; and in the writing period, only the first scanning line is selected.

10. The method of driving a light-emitting device according to claim 6, wherein:

in the at least two correction periods, the first scanning line and at least a second scanning line are selected, and the data line supplies the reference voltage to a pixel circuit connected to the first scanning line and supplies the reference voltage to a pixel circuit connected to the second scanning line;

in the last correction period, the first and second scanning lines are selected; and in the writing period, only the first scanning line is selected.

11. The light-emitting device according to claim 1, wherein the EL transistor is directly connected to the light-emitting element, and the EL transistor is on during the initialization period.

12. The method of driving a light-emitting device according to claim 3, wherein the EL transistor is directly connected to the light-emitting element, and the EL transistor is on during the initialization period.

13. The light-emitting device according to claim 4, wherein the EL transistor is directly connected to the light-emitting element, and the EL transistor is on during the initialization period.

14. The method of driving a light-emitting device according to claim 6, wherein the EL transistor is directly connected to the light-emitting element, and the EL transistor is on during the initialization period.

15. The light-emitting device according to claim 1, wherein the first scanning line controls only the operation of the write transistor.

16. The method of driving a light-emitting device according to claim 3, wherein the first scanning line controls only the operation of the write transistor.

17. The light-emitting device according to claim 4, wherein the first scanning line controls only the operation of the write transistor.

18. The method of driving a light-emitting device according to claim 6, wherein the first scanning line controls only the operation of the write transistor.

* * * * *